US008215928B2

(12) United States Patent
Agrawal et al.

(10) Patent No.: US 8,215,928 B2
(45) Date of Patent: Jul. 10, 2012

(54) FOIL GAS BEARING SUPPORTED HIGH TEMPERATURE CENTRIFUGAL BLOWER AND METHOD FOR COOLING THEREOF

(75) Inventors: Giridhari L. Agrawal, Simsbury, CT (US); Charles William Buckley, West Hartford, CT (US); Ali Shakil, Manchester, CT (US)

(73) Assignee: R&D Dynamics Corporation, Bloomfield, CT (US)

( * ) Notice: Subject to any disclaimer, the term of this patent is extended or adjusted under 35 U.S.C. 154(b) by 951 days.

(21) Appl. No.: 12/244,271

(22) Filed: Oct. 2, 2008

(65) Prior Publication Data

US 2009/0087299 A1 Apr. 2, 2009

Related U.S. Application Data

(60) Provisional application No. 60/976,971, filed on Oct. 2, 2007.

(51) Int. Cl.
*F04B 39/06* (2006.01)
*F04B 39/02* (2006.01)

(52) U.S. Cl. ..... 417/373; 417/423.8; 415/178

(58) Field of Classification Search ..... 417/373, 417/423.8, 423.12, 423.1, 423.14; 415/178, 415/206, 211.2, 229, 143; 416/198, 203
See application file for complete search history.

(56) References Cited

U.S. PATENT DOCUMENTS 2,226,986 A 12/1940 Wechsberg et al.
2,735,027 A 3/1951 Formhals et al.
2,694,157 A 11/1954 Cone
2,972,309 A * 2/1961 Bollibon et al. ..... 417/373
2,994,004 A * 7/1961 Macha et al. ..... 310/86
3,022,739 A 2/1962 Herrick et al.
3,094,272 A 6/1963 McClure
3,296,824 A 1/1967 Rohrs et al.
3,394,659 A * 7/1968 Van Alen ..... 417/373
4,120,616 A * 10/1978 Dwyer et al. ..... 417/373
4,167,295 A 9/1979 Glaser
4,362,020 A 12/1982 Meacher et al.
4,523,896 A 6/1985 Lhenry et al.
4,558,228 A 12/1985 Larjola
(Continued)

OTHER PUBLICATIONS

Giri L. Agrawal, Foil Air/Gas Bearing Technology—An Overview, Presented at the International Gas Turbine & Aeroengine Congress Exhibition, Jun. 2-Jun. 5, 1997, pp. 1-11, 97-GT-347.

*Primary Examiner* — Anne Hines
*Assistant Examiner* — Jose M Diaz
(74) *Attorney, Agent, or Firm* — McCormick, Paulding & Huber LLP

(57) ABSTRACT

This invention provides a blower design capable of high temperature operation due to use of a self-sustaining cooling scheme through a sealed motor housing in which a cooling circuit can be created, and the use of a thermal barrier across which a temperature gradient may be formed. The thermal barrier may be formed by a thermal choke plate assembly positioned between a hot side and a cold side of the blower to dissipate heat conducted from the hot side. Alternatively, the thermal barrier may be formed by an internal fan ring provided with the blower's rotating assembly to dissipate heat conducted from the blower's impeller. The thermal choke plate assembly and the fan ring may further be used in combination to block heat transfer by all modes between a hot side and a cold side of the blower.

35 Claims, 12 Drawing Sheets

U.S. PATENT DOCUMENTS 4,614,482 A * 9/1986 Gaffal ..... 417/367
4,865,517 A 9/1989 Beehler
5,045,711 A 9/1991 Swearingen
5,310,311 A 5/1994 Andres et al.
5,375,651 A 12/1994 Colwell
5,634,723 A * 6/1997 Agrawal ..... 384/106
5,845,509 A 12/1998 Shaw et al.
5,857,348 A 1/1999 Conry
6,102,672 A 8/2000 Woollenweber et al.
6,155,802 A 12/2000 Choi et al.
6,307,278 B1 10/2001 Nims et al.
6,375,438 B1 4/2002 Seo
6,450,781 B1 9/2002 Petrovich et al.
6,471,493 B2 10/2002 Choi et al.
6,498,410 B1 12/2002 Yashiro et al.
6,499,955 B2 12/2002 Choi et al.
6,523,366 B1 2/2003 Bonaquist et al.
6,579,078 B2 6/2003 Hill et al.
6,634,853 B1 10/2003 Anderson
6,830,842 B2 12/2004 Siepierski et al.
6,951,241 B1 10/2005 Gatley
6,997,686 B2 2/2006 Agrawal et al.
7,063,519 B2 6/2006 Agrawal et al.
7,591,632 B2 * 9/2009 Baecke et al. ..... 415/131
7,614,853 B2 * 11/2009 Saville ..... 416/244 A
2004/0189126 A1 9/2004 Brunet et al.
2009/0028730 A1 * 1/2009 Radermacher et al. .... 417/423.8

* cited by examiner

FOIL GAS BEARING SUPPORTED HIGH TEMPERATURE CENTRIFUGAL BLOWER AND METHOD FOR COOLING THEREOF

CROSS-REFERENCE TO RELATED APPLICATION

This application claims the benefit of U.S. Provisional Application No. 60/976,971, filed Oct. 2, 2007, which is incorporated herein by reference.

FIELD OF INVENTION

The field of the present invention generally pertains to the conception, design and manufacture of turbomachinery, such as blowers and compressors, and associated technologies integrating such devices, and more particularly to centrifugal-type motor driven blowers and compressors capable of operating at high temperatures for use in various applications from heat treat furnaces, fuel cell systems for transportation, and other commercial uses. The present invention also generally pertains to the cooling of such turbomachinery, and more particularly to cooling centrifugal-type motor driven machines capable of operating at high temperatures as described herein.

BACKGROUND OF THE INVENTION

Historically, positive displacement machines and turbomachines, such as blowers and compressors, have been used to generate compressed or pressurized gas. Turbomachines are high technology machines that typically involve high engineering, production and assembly costs in order to achieve and maintain desired levels of performance and efficiency with reduced repair and safety concerns. Such high costs are typically due to complex design issues, lengthy assembly procedures, and detailed maintenance requirements, all greatly influenced by the operational requirements for the machinery. For example, fuel cell systems used in diverse stationary, mobile, military and commercial applications use blowers and compressors to pressurize high temperature process gas, but require the machinery to fit a tight footprint so as to not take up too much space, without compromising operation and efficiency of the overall system. Additionally, suitable blowers and compressors have long been desired to achieve high reliability and maintain high efficiency at high operating temperatures. Because of the high temperatures exerted on and by any systems using such machines, adequate insulation, cooling, design and safety precautions are required. However, these concerns must be addressed without affecting the desired size of the blowers and compressors.

There exist several patents on high temperature blowers for various applications that range from heat treat furnace blowers to blowers for simple cooking ovens. One such blower, as described in U.S. Pat. No. 2,694,157, uses a fan-bladed impeller, ball bearings, an electric motor, and secondary air to operate in a heat treat furnace environment with elevated temperatures. This prior art design, while good for a simple bulky application, lacks sufficient design features required to operate in an environment where the process gases are volatile or hazardous to the environment. These machines are also often very large in size due to low operational rotating speeds, and as so sized, are usually insufficient for installation many high temperature applications. Moreover, such blowers are often too big for many modern applications and the size cannot be reduced without compromising operation, efficiency, and safety, especially when used in high temperature applications. The blower also has low efficiency and uses ball bearings that require regular service intervals and can also cause contamination to the process through leaking seals. The use of such motor-driven machines—where process gas has been transported by various designs using oil lubricated ball bearings—are typically unreliable at high temperatures (about 1600° F.) due to oil coking and oil migration, insufficient cooling capacity, contamination, and safety hazards.

Another patent, U.S. Pat. No. 5,375,651, describes a high temperature draft blower for use in furnace applications at temperatures of about 400-450° F. The blower design uses a squirrel cage style impeller mated to a conventional motor using a heat shield to protect the motor from the elevated temperatures in the blower housing. The blower has an estimated overall efficiency of only about 20%, and uses an electric motor that is exposed to the environment. Such a design is undesirable due to high susceptibility to contamination, especially to the motor, which effects overall operation and efficiency of the blower.

U.S. Pat. No. 6,951,241 discusses a method of cooling a high temperature furnace blower motor to keep the internal bearings cool during operation to increase the life of the blower. The method uses holes provided in the motor housing and at the impeller back plate to cool the blower. Specifically, the holes allow external air to be drawn into the blower housing and over the motor and then into the impeller portion of the blower housing. Hot air goes out through an exhaust port incorporated into the blower housing design. Due to limited cooling capacity from such a design, the blower is highly inefficient. Noise levels are also very high, even where a secondary cooling fan—typically used in such a design—is eliminated. Moreover, the ball bearings used inside the blower do not reduce noise levels to satisfactory levels. Additionally, since the holes in the blower housing are critical to drawing in external air to cool the motor and the impeller in such a design, the blower cannot be hermetically sealed. As a consequence, the process gas can easily mix with ambient air, which can be hazardous, especially at the high temperatures to which such a blower may be subjected.

In view of the foregoing, there is a need for a blower design that can operate efficiency at high temperatures, in a small, compact size, without suffering from the drawbacks common to prior art blower designs that tend to affect performance, operation and efficiency, and moreover, tend to compromise product safety. Accordingly, it is a general object of the present invention to provide a high temperature blower that overcomes the problems and drawbacks associated with the use of blowers at high temperatures (e.g., about 1600° F.).

The proposed high temperature centrifugal blower of the present invention avoids the drawbacks common to prior art blower designs, such as those discussed above, by using a unique internal cooling circuit that is self-sustaining. There is need for a blower design for use at high temperatures that is hermetically sealed and thus does not allow any leaking of the process gas. The present invention also uses foil gas bearing technology that permits a sealed, contamination fee, high speed, efficient, self-cooling centrifugal blower system. Such foil gas bearing technology also has no sliding contact of surfaces, and hence, improves the efficiency and reduces noise levels in the unit.

SUMMARY OF THE INVENTION

In one aspect of the present invention, a high temperature, motor driven, foil gas bearing supported blower is provided. The blower comprises a blower hot side including a volute with a process gas inlet and a process gas outlet, a diffuser attached to the volute for directing the flow of the process gas through the volute, and an impeller mounted for rotation about a central longitudinal axis within the volute for processing the gas as it flows through the volute. The blower also comprises a blower cold side including a sealed motor housing defining an interior cavity, a rotating assembly disposed within the interior cavity of the motor housing, and a motor stator assembly mounted within the motor housing. The rotating assembly comprises a rotating shaft mounted for rotation about the central longitudinal axis and a motor rotor mounted on the rotating assembly for rotation therewith, wherein the impeller is mounted at an end of the rotating assembly for rotation therewith. The blower further comprises a thermal barrier positioned between the blower hot side and the blower cold side for reducing heat transfer from the blower hot side to the blower cold side.

The blower design of the present invention may utilize an innovative thermal choke plate assembly to define a thermal barrier separating the blower into a hot side and a cold side. Preferably, the thermal choke plate assembly provides a significant temperature gradient across the hot and cold sides of the blower.

In one aspect of a preferable thermal choke plate assembly, an outer choke plate is provided adjacent to the hot side of the blower and an inner choke plate is provided adjacent to the cold side of the blower. The outer and inner choke plates are connected to one another at a neck portion transition along the inner diameter of each respective choke plate. Additionally, spacers may be provided between the choke plates to add rigidity and stiffness, as well as to aid in the dissipation of heat between the choke plates.

In operation, the thermal choke plate assembly of the present invention blocks heat transfer from the hot side to the cold side of the blower, including by blocking heat conduction as heat dissipates through the choke plates. In particular, heat is dissipated from the thermal choke plate assembly as it passes from the outer choke plate to the inner choke plate to form a temperature gradient across the hot and cold sides of the blower. A radiation heat shield may also be mounted with the thermal choke plate assembly to block radiation from passing from the hot side of the blower to the cold side.

The blower design of the present invention may utilize an innovative fan ring design provided on the rotating assembly, preferably between the impeller and the motor rotor. The fan ring comprises a generally longitudinal hub portion having a first end and a second end and is mounted on the rotating assembly for rotation therewith. The fan ring also comprises a radial cooling fan at the second end and having a plurality of fan blades facing the blower cold side. The fan ring further comprises a bellows feature positioned intermediate the first and second ends and including a plurality of heat fins extending radially from the hub portion. Heat conducted from the impeller is dissipated by the fan ring.

The fan ring may also define a seal within the blower to block the leakage of process gas from the blower hot side to the blower cold side.

Moreover, a thermal choke plate assembly in accordance with an aspect of the present invention may work in conjunction with internal cooling components, such as an internally disposed fan ring, and a sealed motor housing to balance convection and radiation heat transfer across the blower.

In another aspect of the present invention, a rotating assembly is defined for use in a centrifugal blower. The rotating assembly comprises a rotating shaft mounted for rotation about an axis, an impeller mounted at a first end of the rotating shaft, at least two hydrodynamic foil bearing assemblies mounted in association with the blower for supporting the rotating shaft, a motor rotor forming an armature of the blower, said rotor being mounted for rotation with the rotating shaft, and a fan ring. A tie rod extending along the axis of rotation is provided for holding the impeller, the rotating shaft, the motor rotor, and the fan ring under preload.

The present invention may use foil gas conical bearings or foil gas journal bearings, or both.

In another aspect of the present invention, the blower housing is sealed and the motor of the present invention is preferably self-contained. An ingenious closed circuit, sealed and self-sustaining cooling cycle is formed within the blower housing to cool the motor and other internal components. The cooling circuit is aided by a fan ring mounted on the rotating assembly of the blower. A fan ring in accordance with an aspect of the present invention acts, in part, as a cooling fan to draw cooling air through the motor housing of the blower and to take heat from internal components therein. The fan ring also may act as a seal to prevent leakage of hot gas from the impeller into the motor housing. Further, the fan ring may act to dissipate such hot gas away from the rotating assembly and impeller. A secondary fan may be added to aid in circulating air within the blower housing. Additionally, hot process gas transported via the centrifugal blower is not allowed to escape through the blower housing to the atmosphere, improving the efficiency and safety of the system in which the blower is used.

The present invention is also directed to a method for cooling a centrifugal blower. The method includes the steps of providing a sealed blower housing having a front end and a rear end and defining an axial interior cavity, radially disposed cooling channels, a front end cavity and a rear end cavity, providing a plurality of cooling fins about the outer surface of the blower housing, said cooling fins being generally adjacent the radially disposed cooling channels inside the blower housing, and providing a rotating assembly within the axial interior cavity. The rotating assembly is mounted for rotation about an axis and comprises a rotating shaft, an impeller mounted at a first end of the rotating shaft and being disposed within a volute, and a fan ring adjacent to the impeller and having a radial cooling fan facing the rear end of the blower housing and including a plurality of fan blades. The method further includes drawing gas through the axial interior cavity of the blower housing along the rotating assembly by rotating the radial cooling fan, said gas taking up heat from components of the rotating assembly. The method further includes distributing the hot gas into the front end cavity and directing the hot gas to and through the radially disposed cooling channels. The hot gas is cooled as it passes through the radially disposed cooling channels by conducting heat from the hot gas from the cooling channels to the cooling fins where the heat may be released therefrom to the ambient air around the blower housing. The method further includes distributing the cooled gas to the rear end cavity where it may be drawn into and through the axial interior cavity by rotation of the radial cooling fan.

The method of the present invention may further include reducing heat transfer from the impeller. Such a reducing step can be achieved with a thermal choke plate assembly in accordance with the present invention, a fan ring in accordance with the present invention, or a combination of the two.

The present invention, in another aspect, is also directed to a method of cooling a blower comprising forming a thermal barrier in the blower to separate a blower hot side from a blower cold side and to reduce heat transfer therebetween. Such a thermal barrier may be formed by a thermal choke plate assembly in accordance with the present invention, a fan ring in accordance with the present invention, or a combination of the two.

The blower design of the present invention provides advantages in that it can achieve high reliability at high temperatures (preferably up to about 1600° F.), with high efficiency in a small size that is desirable for various applications.

Additionally, the design of the present invention provides advantageous operating levels with an overall operating efficiency above 50%.

The blower design of the present invention has the advantage of being compact without compromising operation capacity. Further, the blower design is easy to install in commercial and military systems, such as fuel systems for transportation, automotive exhaust after treatment systems, heat furnace blowers, and the like, to improve efficiency.

These and other features of the present invention are described with reference to the drawings of preferred embodiments of a foil gas bearing supported centrifugal-type blower. The illustrated embodiments of the blower of the present invention are intended to illustrate, but not limit the invention.

DETAILED DESCRIPTION OF THE INVENTION AND PREFERRED EMBODIMENTS THEREOF

Figure 1:
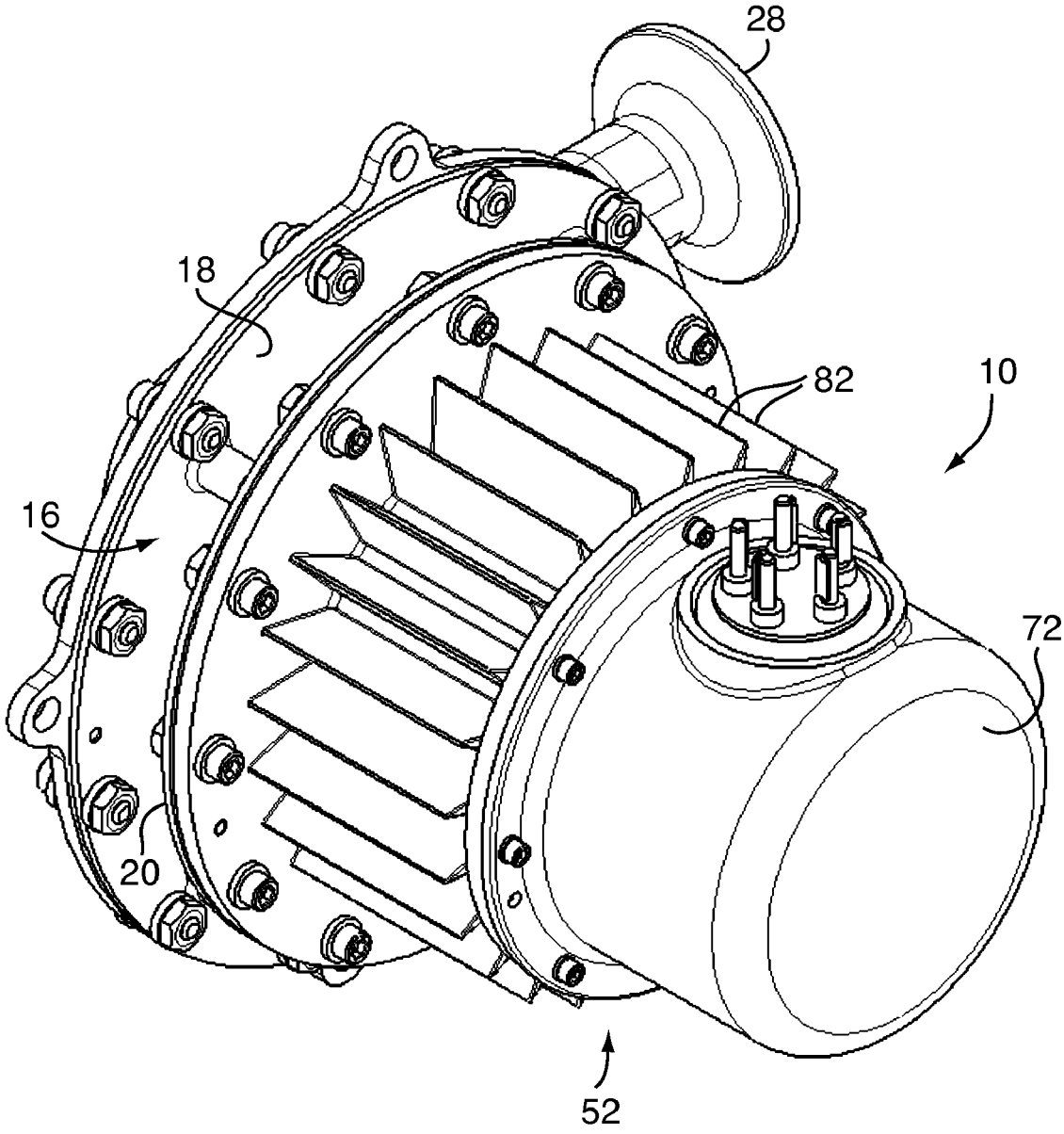
FIG. 1 shows a perspective view of a blower assembly in accordance with the present invention.
Figure 2:
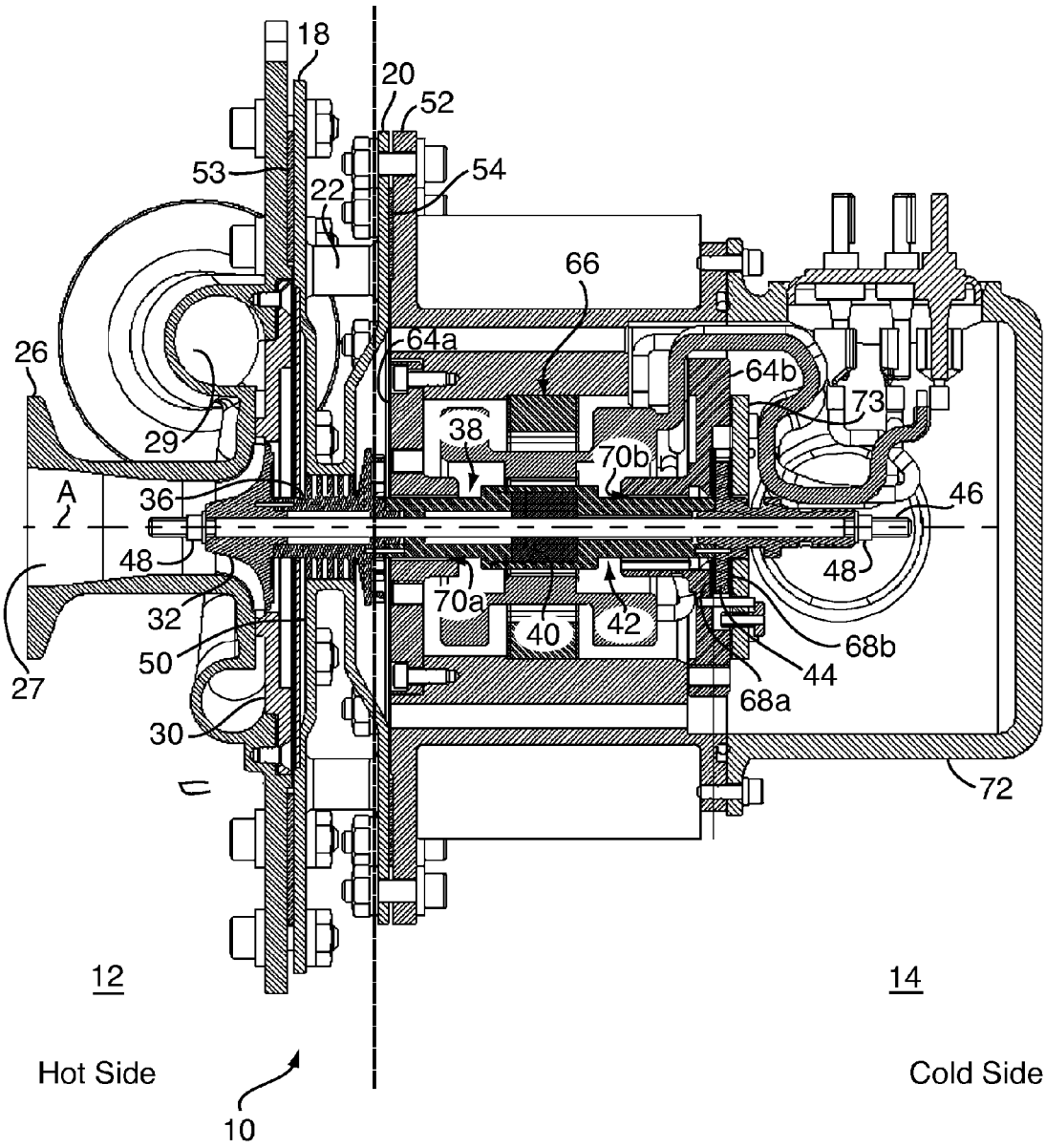
FIG. 2 shows a detailed cross-sectional view of the blower assembly of FIG. 1.

A turbomachine in accordance with the present invention is generally illustrated in FIGS. 1 and 2. As shown and described hereinafter, the illustrated turbomachine is a blower, generally designated by reference numeral 10. A perspective view of a preferable high temperature, high-speed foil gas bearing supported blower 10 incorporating the design concepts of the present invention is shown in FIG. 1. A cross-sectional view of the blower 10 in accordance with the present invention is shown in FIG. 2. More particularly, FIG. 2 illustrates separate "hot" and "cold" sides of the blower 10 and a thermal barrier formed therebetween to reduce and preferably prevent heat transfer from the "hot side" to the "cold side", as described in more detail below. Though illustrated and described as blower 10, the present invention has application in all types of turbomachinery known to the person of ordinary skill in the art, including compressors. In general, the blower 10 of the present invention is intended to operate in high temperature conditions, for example, handling process gas at up to about 1600° F.

As shown in FIG. 2, the blower 10 of the present invention can be divided into a hot side, generally designated by reference numeral 12, and a cold side, generally designated by reference numeral 14. In short, the "hot side" is so designated because of the high temperatures of the process gas passing through that portion of the blower 10. By comparison, the "cold side" is so designated because of the aim to keep the components on that side of the blower at lower temperatures. Additionally, the components on the cold side 14 must be cooled during operation to maintain desirable levels of performance and efficiency during operation. Accordingly, the present invention has been designed to reduce and ideally prevent heat transfer due to hot process gas from the hot side 12 to the cold side 14. More particularly, the present invention is aimed at blocking all the modes of heat transfer—namely, convection, conduction and radiation. As discussed in more detail below, this is accomplished, in part, by an innovative thermal choke plate assembly, generally designated by reference numeral 16 and shown in FIG. 3.

Figure 3:
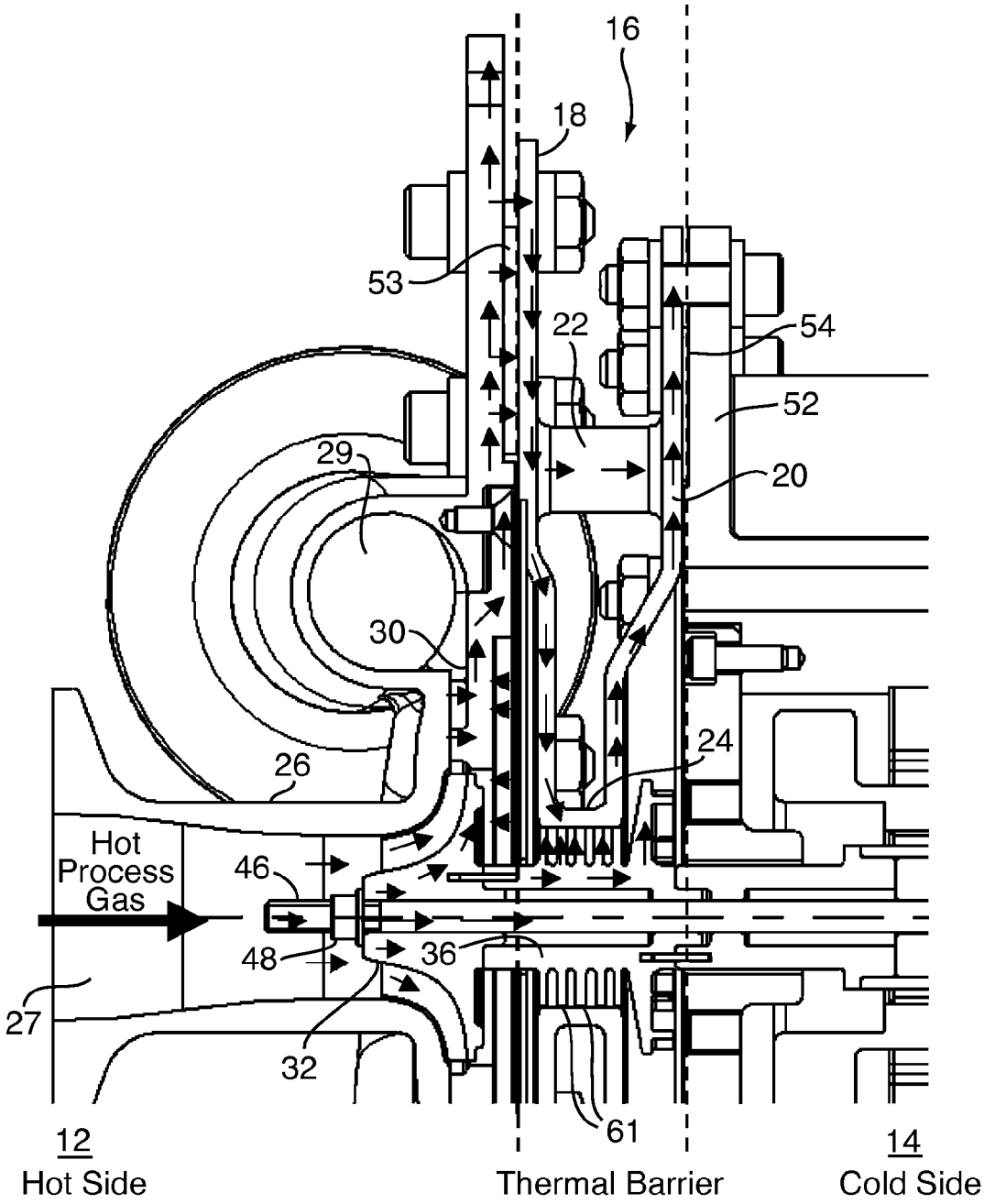
FIG. 3 shows a cross-section of a thermal choke plate assembly for use in the blower assembly of FIG. 1, and particularly illustrating a preferable heat flow path across the blower assembly of the present invention.

As shown in FIG. 3, the hot side 12 is separated from the cold side 14 by the thermal choke plate assembly 16 that forms a thermal barrier. The thermal choke plate assembly 16 preferably comprises an outer choke plate 18 (disposed adjacent to the hot side 12 of the thermal barrier) and an inner choke plate 20 (disposed adjacent to the cold side of the thermal barrier). Preferably, the choke plates 18 and 20 are mounted generally parallel to one another. The outer and inner choke plates 18 and 20 are preferably designed with thin sections that facilitate quick heat dissipation. The plate designs cause heat to travel through the thin sections for minimum heat conduction and maximum heat dissipation through natural convection. Additionally, the inner choke plate 20 is designed to have a greater surface area than the outer choke plate 18. As illustrated in FIG. 3, greater surface area can be provided in the inner choke plate 20 by adding an angular contour. As discussed below, the greater surface area of the inner choke plate 20 helps to direct heat transferred from the hot side 12 to the atmosphere before is can be passed to the cold side 14 of the blower 10. Accordingly, the thermal barrier formed by the thermal choke plate assembly 16 acts as a thermal choke to protect the cold side 14 of the blower 10 and provide a significant temperature gradient across the hot and cold sides 12 and 14 of the blower 10.

Further, the outer and inner choke plates 18 and 20 may be separated by spacers that add stiffness to the assembly 16. For example, as shown in FIG. 3, the outer choke plate 18 and the inner choke plate 20 are held together via a plurality of ribs 22 that provide rigidity and stiffness to the structure. In the embodiment shown, the thermal choke plate assembly 16 is manufactured by one-piece machined casting. Alternatively, the assembly 16 may be formed by spin forming the outer and inner choke plates 18 and 20 with a neck portion on each, press fitting them together at the neck portion and electron beam welding them together along the inside diameter. A one-piece neck portion transition of the thermal choke plate assembly can be seen in FIG. 3, as designated by reference numeral 24.

The hot side 12 of the blower 10 generally comprises a volute 26, a diffuser 30, and a centrally disposed centrifugal impeller 32 mounted for rotation within the blower 10 about a central longitudinal axis A. All components on the hot side 12 must be able to withstand extreme temperatures. The volute 26 includes an inlet 27 for the process gas to be processed, and a peripherally disposed outlet 28 for discharging processed gas. The volute inlet 27 is generally aligned with the central longitudinal axis A of the blower 10. The diffuser 30 is attached to the volute 26 by using machine screws. The diffuser 30 can also be electron beam welded to the volute 26. The diffuser 30 includes a plurality of low solidity vanes (not shown) radially disposed on and about a diffuser plate (seen in cross-section in FIG. 2). As is typical for the design of diffusers, the diffuser vanes are positioned around a central opening for mounting the diffuser around a rotating shaft on which the impeller 32 is mounted. The vanes are preferably cambered, air-foil shaped, permitting operation at low flow without surging. The vanes are also preferably flushed on the interior surface of the volute 26 to avoid any flow leakage. The diffuser 30 has an inlet and an outlet generally corresponding to the volute inlet 27 and volute outlet 28, respectively, to direct the flow of the process gas as if moves through the hot side 12 of the blower 10. The volute 26 preferably comprises a logarithmic, spiral-shaped channel, shown in cross-section in FIG. 2 as reference numeral 29, in which process gas discharged from the impeller 32 is collected, with gradually increasing area from the outlet of the diffuser 30 to the volute outlet 28. The processed gas is eventually discharged out of the volute outlet 28.

Figure 4:
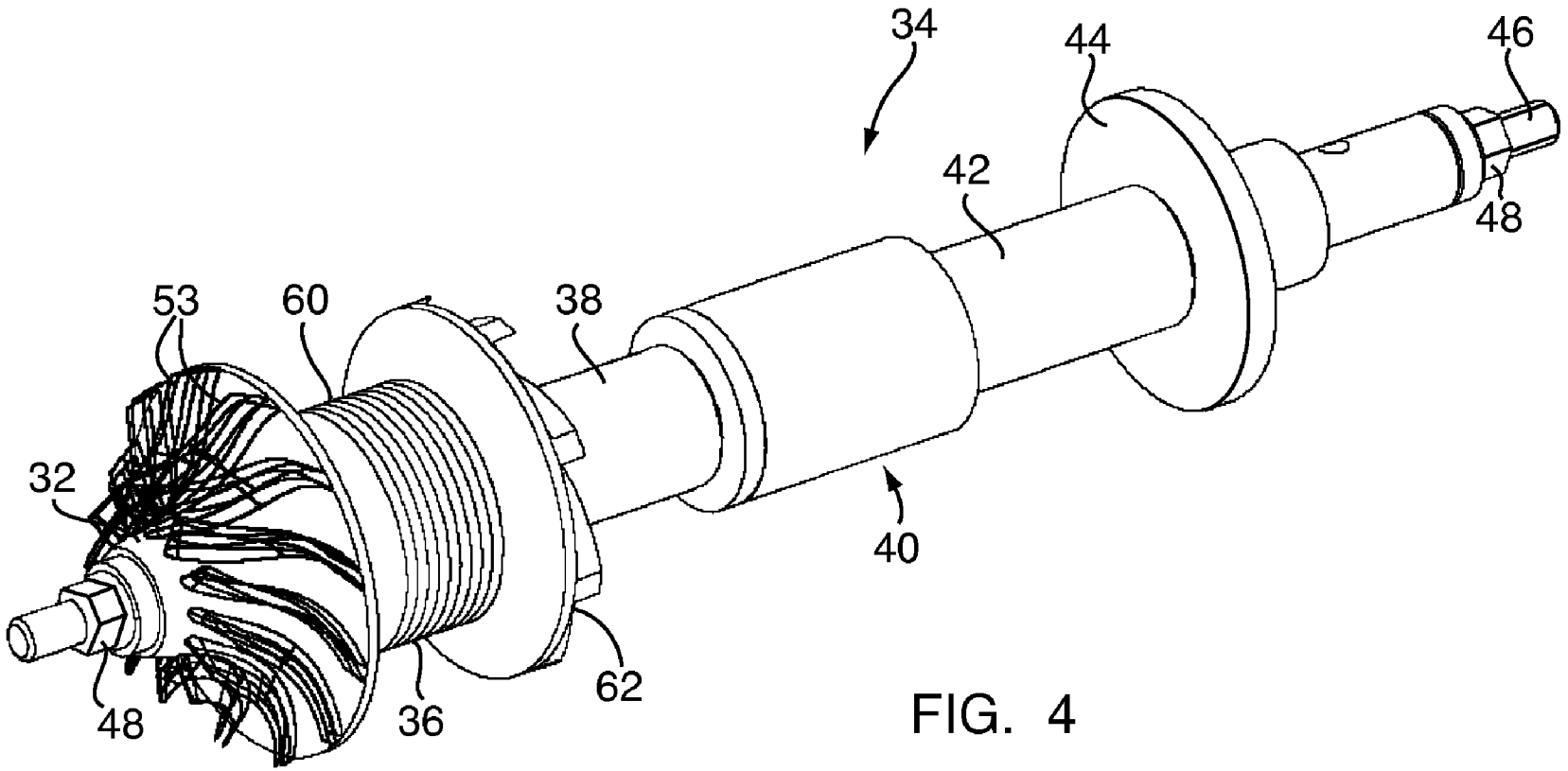
FIG. 4 shows a perspective view of an exemplary rotating assembly that may be used in a blower assembly in accordance with the present invention.

The impeller 32 is part of a rotating assembly mounted for rotation within the blower housing. The rotating assembly, generally designated herein by reference numeral 34, is illustrated in FIG. 4, and generally comprises the impeller 32, a fan ring 36, an impeller shaft portion 38, a motor rotor 40, a thrust shaft portion 42, and a thrust runner 44. A tie rod 46 clamps the elements of the rotating assembly 34 together and rigidly holds them under a pre-load, along with lock nuts 48 positioned at each end of the assembly to counteract any centrifugal loading while the blower 10 operates at high speeds. The rotating assembly 34 is preferably driven by a high speed, high temperature motor, the rotor 40 of which is preloaded inside the rotating assembly 34. The motor can be a switched reluctance, induction or brushless DC permanent magnet motor.

Though the rotating assembly 34 is illustrated in FIG. 4 as including separate shaft portions—namely, the impeller shaft portion 38 and the thrust shaft portion 42—the present invention can also be constructed with a single rotating shaft to which the motor rotor 40, for example, can be mounted. That being said, in the embodiment shown, the impeller 32 is attached to the fan ring 36, which is in turn attached to the impeller shaft portion 38. The impeller shaft portion 38 is attached to the thrust shaft portion 42 by press fitting adjacent ends thereof together. Preferably, an end of the impeller shaft portion 38 fits within an end of the thrust shaft portion 42, with the junction between the two portions being electron beam welded together to ensure a sure and tight fit. Additionally, the motor rotor 40, preferably a high temperature motor magnet, is also press fitted inside an end of the thrust shaft portion 42 so that it is sandwiched and held tight between the impeller shaft portion 38 and thrust shaft portion 42. As so preloaded, the motor rotor 40 will not develop any tensile strain during operation of the motor. The thrust runner 44 is mounted on the thrust shaft portion 42, though in an alternate design, the thrust runner 44 can be integral with the rotating shaft.

When the rotating assembly 34 is mounted in position within a fully assembled blower 10, the impeller 32 is positioned on the hot side 12 of the blower 10. As seen more particularly in FIGS. 2 and 3, the axial portion of the impeller 32 is positioned properly in the volute inlet 27 with the outwardly disposed radial edge of the impeller 32 being positioned closely to the diffuser inlet. The volute 26 has a smoothly contoured shroud portion that fits closely around the impeller blades to minimize leakage levels. In operation, the impeller 32 rotates close to the volute 26, and the diffuser vanes are positioned about and cooperate with the impeller outlet (i.e., along the radial edge) to direct the processed gas into the volute channel 29 and towards the volute outlet 28.

The impeller 32 is preferably designed for optimum flow coefficient and for various speeds and flows. As shown more particularly in FIG. 4, the impeller 32 comprises multiple blades or vanes 33 that define passages for gas passing through the impeller 32 between its inlet and outlet. The blades 33 are preferably three-dimensional, aerodynamic, S-shaped blades connected to the impeller base with full inducer portions serving to guide the in-flow of gas more evenly through the impeller in order to limit curvature losses. The volute 26 surrounds the impeller 32 such that gas discharged by the impeller 32 is collected in the volute channel 29.

In operation, the blower 10 draws gas axially through the volute inlet 27 and pressurizes the gas while passing it through the impeller blades 33. The impeller 32 raises the pressure of the process gas by centrifugal action. The processed gas is passed through the diffuser 30 to increase the pressure furthermore. The processed gas exits the blower 10 after finally passing through the volute channel 29. In many applications with which the present invention is intended to be used, including fuel cell systems for transportation, automotive exhaust after treatment systems, heat furnace blowers, and various additional commercial and military uses, the process gas is typically drawn in at extremely high temperatures—e.g., about 1600° F. In order to avoid the drawbacks and complications of prior art blower designs, the blower 10 must adequately accommodate the high temperatures through the hot side 12 while restraining heat transfer to the cold side 14.

Materials chosen for the volute 26, diffuser 30 and the impeller 32 are high temperature capable and have similar coefficients of thermal expansion so as to maintain the same axial and radial clearances between the shroud contour of the volute 26 and impeller blades 33 while running at extreme speeds and temperature.

The hot side 12 of the blower 10 further includes a radiation heat shield 50 positioned against the exterior surface of the volute 26. The radiation heat shield 50 has a polished surface, preferably manufactured from a highly polished metallic material, facing the hot side 12 with low emissivity and high reflectivity, that, in operation, blocks heat from the hot side 12 and more preferably reflects back heat radiated by the volute 26, the diffuser 30 and the impeller 32. Preferably, the radiation heat shield 50 is slip fitted onto a step provided in the outer choke plate 18, which is likewise fitted against the volute 26. The radiation heat shield 50 may be spot welded to the outer choke plate 18 where desired.

As noted above, and shown more particularly in FIG. 3, the thermal choke plate assembly 16 is positioned between the hot side 12 and the cold side 14 of the blower 10, defining a thermal barrier therebetween. Specifically, the assembly 16 is sandwiched between the volute 26 of the hot side 12 and a machine housing 52 on the cold side 14. Compression load is applied to both sides of the blower 10, preferably via machine screws, to prevent leakage through the blower 10. A high temperature gasket 53 also is provided between the outer face of the outer choke plate 18 and the inner face of the volute 26. A similar gasket 54 may be used between the inner face of the inner choke plate 20 and the outer face of the machine housing 52, though a thinner gasket may be acceptable due to lower temperatures at this junction.

Heat may be transferred to the outer choke plate 18 via all three modes of heat transfer. However, the dominant mode of heat transfer to the outer choke plate 18 is conduction, as illustrated by the arrows in FIG. 3. Maximum heat is conducted to the outer choke plate 18 at the junction where it meets the volute 26, through high temperature gasket 53. The majority of this heat then moves toward the neck portion 24 of the thermal choke plate assembly 16, and passes through the transition to the inner choke plate 20. Some of the heat from the hot side 12 is also conducted from the outer choke plate 18 to the inner choke plate 20 through the spacer ribs 22. The design of the inner choke plate 20, with a greater surface area than the outer choke plate 18, enhances natural convection and radiation heat transfer to the atmosphere. Thus, by the time the heat reaches the junction point between the inner choke plate 20 and the machine housing 52, the temperature has been significantly cooled down, thus creating a thermal barrier between the hot side 12 and the cold side 14.

The neck portion 24 of the thermal choke plate assembly 16 can also assist in dissipating heat generated by the impeller 32. For example, the neck portion 24 is preferably disposed adjacent to the rotating assembly 34. Heat from the rotating assembly 34 may be conducted to the thermal plate assembly 16 via the neck portion 24. The heat passes to the inner choke plate 20 from which it may be dissipated to the ambient air.

The radiation heat shield 50 reflects significant amount of heat from the hot side 12 back to the volute 26, where the surface is rough and has higher absorption properties, thus keeping the face of the outer choke plate 18 cooler. This cooler face conditions the outer choke plate 18 to take up heat conducted from the volute 26 and move it radially inwardly towards the neck portion 24 where the outer and inner choke plates 18 and 20 meet. Heat conducted to the inner choke plate 20 travels radially outwardly away from the neck portion 24, where it is cooled due to the design of the inner choke plate 20 coupled with natural convection and radiation heat transfer to the atmosphere.

Natural convection may be enhanced by designing thin sections into the choke plates 18 and 20. Due to such thin sections on the plates, along with providing a wider surface area for increased natural convection, heat transfer to the atmosphere is significantly enhanced and a thermal barrier is created between the hot side 12 and the cold side 14 of the blower 10 that provides a significant temperature gradient across the thermal barrier. Another way to minimize the heat flow between the hot side 12 and the cold side 14 is to use ceramic spacers instead of metal between the plates 18 and 20.

Figure 5A:
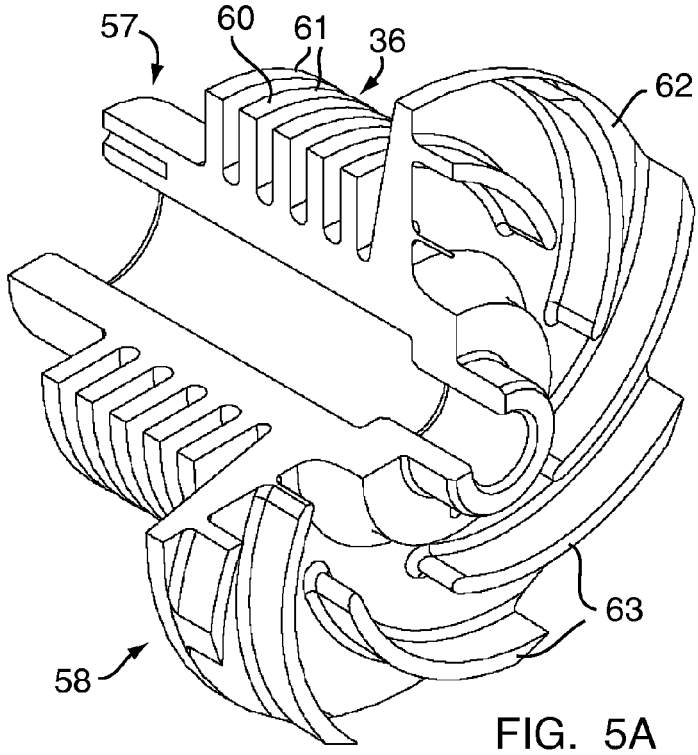
FIGS. 5A and 5B show, respectively, a partial perspective view and a cross-sectional view of a fan ring concept in accordance with the present invention.
Figure 5B:
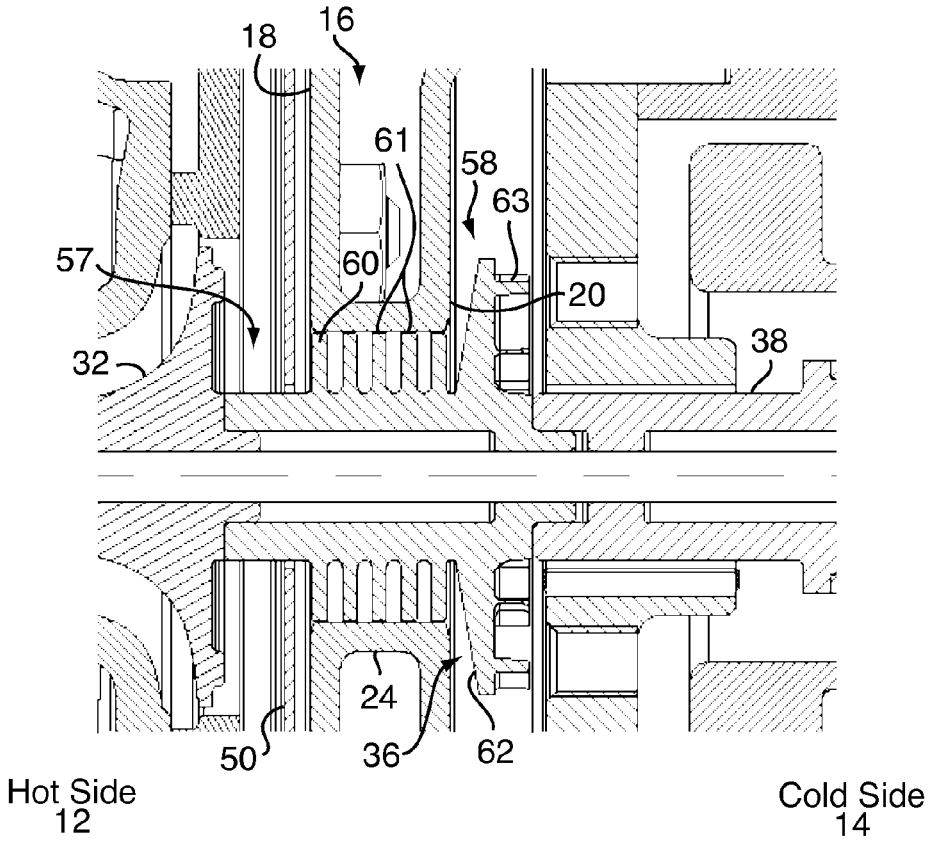

The blower 10 of the present invention also incorporates a very unique cooling fan design described herein as the fan ring 36, shown in FIGS. 5A and 5B. The fan ring 36 serves three distinct functions—namely, it provides thermal resistance to heat flow from the hot side 12 to the cold side 14 along the rotating assembly 34, it acts as a seal to block leakage of hot gas past the impeller 32, and it acts as a radial cooling fan to keep the components on the cold side 14 of the blower 10 at a desirable temperature during operation. While heat fins, labyrinth seals and cooling fans have been used heretofore in blowers, the fan ring 36 of the present invention accommodates all functions while greatly reducing the number of parts.

As shown in FIGS. 5A and 5B, the fan ring 36 comprises a generally longitudinal hub portion 56 having a first end 57 on which the impeller 32 is mounted and an opposite end 58 that connects to the impeller shaft portion 38 of the rotating assembly 34. The fan ring 36 is fitted between the impeller 32 and the impeller shaft portion 38 using dowel pins. Accordingly, the fan ring 36 rotates with the entire rotating assembly 34 during operation of the blower 10. The fan ring 36 may be cast or fully machined.

The fan ring 36 is provided within the blower 10 to form an internal thermal barrier. In a preferred embodiment of the present invention, the fan ring 36 works in conjunction with the thermal choke plate assembly 16 to define an extensive thermal barrier to block all modes of heat transfer between the hot side 12 and the cold side 14 of the blower 10. Though shown as a component that forms part of the rotating shaft of the rotating assembly 34, the fan ring 36 may also be designed as a separate piece that is mounted on a rotating shaft and fitted into position.

The fan ring 36 of the present invention further includes a bellows-resembling feature 60 comprising a plurality of heat fins 61 extending radially outwardly from an intermediate section of the hub portion 56. A radial cooling fan 62 extends radially outwardly from the opposite end 58 of the hub portion 56 and includes a plurality of aerodynamic blades 63 facing the cold side 14 of the blower 10 and profiled to accommodate various speeds and provide various cooling flows.

During operation, heat is conducted through the impeller 32 to the fan ring 36. The bellows feature 60 of the fan ring 36 presents thermal resistance to this heat flow. That is, heat flows from one thin heat fin 61 to the next and so forth. Heat is dissipated from the ends of the fins 61 by via convection and radiation heat transfer. The heat dissipation through the fins 61 is enhanced by the whirl caused by rotation of the rotating assembly 34, thereby causing forced convection on the fins' surfaces. Consequently, the first heat fin—i.e., closest to the impeller 32—tends to be the hottest and the last fin—i.e., closest to the cold side 14 of the blower 10—tends to be the least hot.

The bellow-resembling feature 60 on the fan ring 36 also acts as a knife edge seal that blocks the leakage of hot gas past the impeller 32 by using the tips of the heat fins 61 as a labyrinth seal. The profile of the heat fins 61 may also be tapered. The tip clearance between the heat fins 61 and the neck portion 24 of the thermal choke plate assembly 16 and the inside diameter of the thermal choke plates 18 and 20 is kept to a desirable tolerance to avoid excess flow leakage and rubbing between the fan ring 36 and the thermal choke plate assembly 16, while accommodating thermal growth of both the rotating and stationary parts of the blower 10. The design of the rotating assembly 34 is intended to have a minimal contact area between rotating and stationary parts, which design helps reduce heat transfer within the blower 10 further.

When acting as a cooling fan, the fan ring 36 draws air through the cold side 14 of the blower 10 by taking away heat from various cold side components, such as bearings and the motor. The fan ring 36 also acts to push air through cooling channels formed within the machine housing 52. The internal cooling process is discussed in more detail below. The fan blades 63 stay relatively cooler that the rest of the fan ring 36. Thus, the unique design of the fan ring 36 acts as a thermal barrier, minimizes heat transfer and avoids demagnetization of the motor magnet due to excessive heat when a permanent magnet motor is used.

Accordingly, all the three modes of heat transfer are innovatively blocked by aspects of the present invention. More particularly, convection is balanced by the fan ring 36, as well as cooling fins provided on the machine housing 52, as described in more detail below. Similarly, conduction is blocked by the thermal choke plate assembly 16 and the fan ring 36. Lastly, radiation is blocked by the use of polished surfaces, such as the radiation heat shield 50 to reflect heat away from the cold side 14. Hence the cold side 14 of the blower 10 is kept cool from the hot side 12 of the blower 10.

The cold side 14 of the blower 10, generally shown in FIG. 2, houses the blower's motor. Specifically, the cold side 14 comprises the machine housing 52, a front journal bearing sleeve 64*a*, a motor stator assembly 66, a rear journal bearing sleeve 64*b*, foil gas thrust bearings 68*a* and 68*b*, front and back foil gas journal bearings 70*a* and 70*b*, and an end cover 72. The thrust bearings 68*a* and 68*b* are sealed about the thrust runner 44 of the rotating assembly 34 by an outer plate 73.

The motor of the present invention may be a switched reluctance, induction or brushless DC permanent magnet motor. In general, the motor comprises the motor rotor 40 mounted to or forming part of the rotating assembly 34, and the motor stator assembly 66 disposed around the motor rotor 40 and press fitted into the machine housing 52. In this regard, the machine housing 52, may also be referred to as a "motor housing" or more generally a "blower housing" when used with a particular type of machine, such as, for example, blower 10.

In a preferred motor design, the motor rotor 40 includes a permanent magnet and the motor stator assembly 66 includes coils encircling the motor rotor 40 to operatively interact with the permanent magnet. Preferably, the motor is controlled by a sensorless controller (not shown), which can either be mounted on the machine housing 52 or located along side of it. Thus, the blower 10 gets its input power through the controller, which energizes the motor stator assembly 66, which in turn interacts with the motor rotor 40 to rotate the rotating assembly 34, with impeller 32, at desired high speeds.

The blower 10 is hermetically sealed. It uses a high temperature compressible gasket 53 between the volute 26 and the outer thermal choke plate 18. It also uses a slightly thinner compressible gasket 54 sandwiched between the inner thermal choke plate 20 and the machine housing 52. An end cover 72 is attached to the rear of the machine housing 52 to enclose the internal components on the cold side 14 of the blower 10. On o-ring seal is used between the end cover 72 and the machine housing 52. Hence no process gas can escape through the machine housing 52, which improves the efficiency and safety of the system in which the blower 10 is used.

Figure 6:
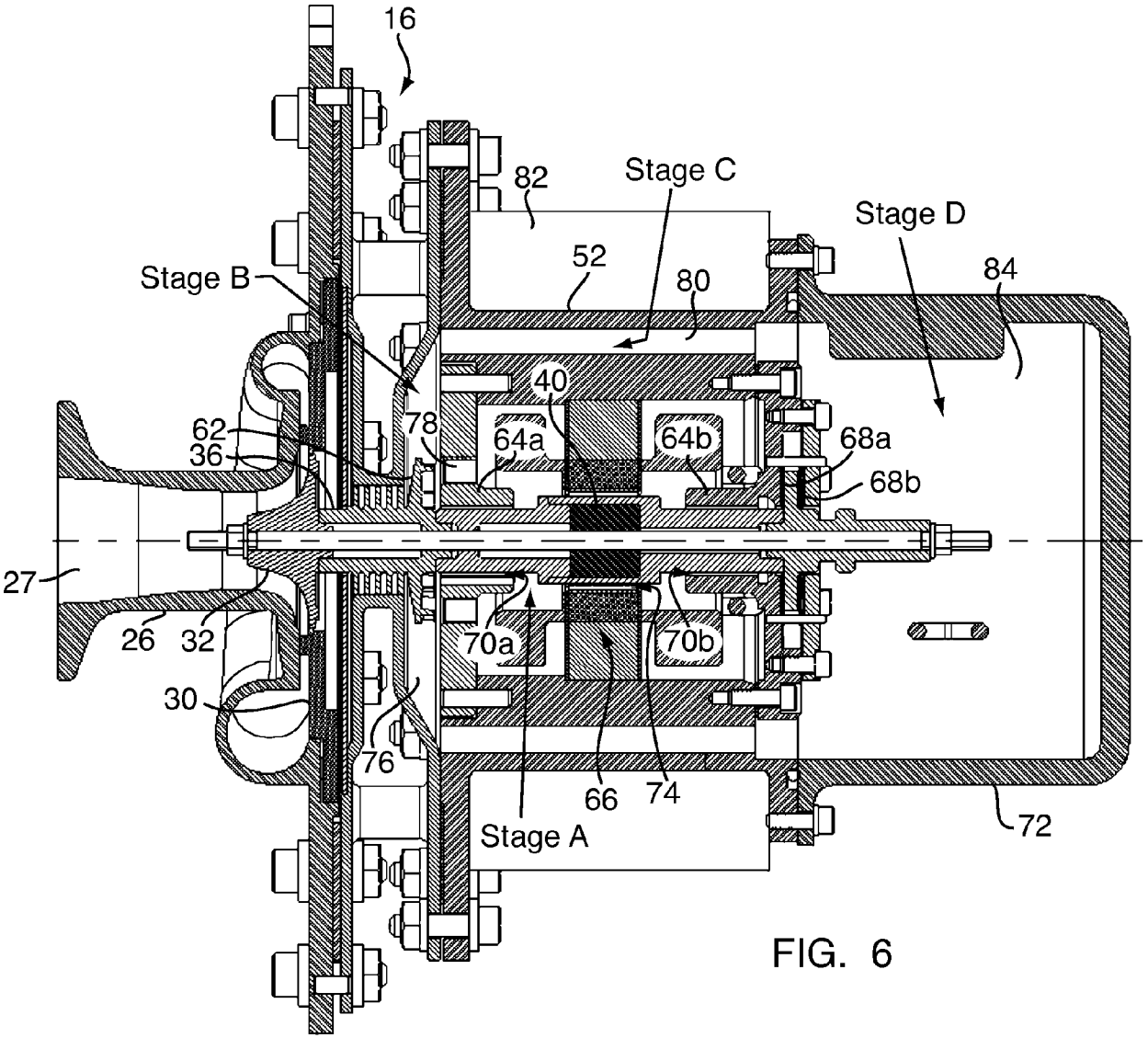
FIG. 6 shows a cross-sectional view illustrating a closed loop internal cooling path within the blower assembly of FIG. 1 in accordance with the present invention.

FIG. 6 shows an innovative and very unique self-sustaining internal cooling circuit for the cold side 14 of the blower 10. Various stages of the airflow are designated with alphabetical identifiers and discussed in more detail below. The radial fan blades 63 on the fan ring 36 draw gas axially through the cold side 14 of the blower 10, typically through the interior cavity housing the rotating assembly 34. As the gas is drawn along the rotating assembly 34, the gas takes up heat generated from the bearings and the motor (stage A). In particular, the gas is drawn into the foil gas thrust bearings 68*a* and 68*b* to cool the bearings and take away heat generated therein and thereby due to bearing friction. The gas continues through the rear foil gas journal bearing 70*b* to take away heat generated therein and thereby due to bearing losses. From there, the gas advances to a gap 74 between the motor stator assembly 66 and the relative position of the motor rotor 40 on the rotating assembly 34. As the gas passes through the gap 74, it carries away heat generated therein due to rotor-stator losses. Finally, the gas passes the front foil gas journal bearing 70*a* and carries away heat generated therein and thereby.

The gas is drawn to the fan ring 36 by the cooling fan 62, which pushes and distributes the gas into a front end cavity 76 formed between the machine housing 52 and the thermal choke plate assembly 16 (Stage B). The gas also passes through a series of holes 78 provided in the front journal bearing sleeve 64*a* to move hot gas into the front end cavity 76. The fan ring 36 directs this hot gas radially toward a series of radially disposed cooling channels 80 provided in the machine housing 52 (Stage C). The hot gas is cooled as it passes through the cooling channels 80. Specifically, the hot gas in the cooling channels 80 contacts the walls of the machine housing 52. The heat is conducted through the walls from the inside of the machine housing 52 to a plurality of cooling fins 82 disposed about the outer surface of the machine housing 52. Heat is then released from the exposed fin surfaces to the ambient air around the machine housing 52 via natural convection and radiation.

The plurality of cooling fins 82 is provided over the outer surface of the machine housing 52. Preferably, the cooling fins 82 are integrally formed into the machine housing 52. Alternatively, a separate fin housing, including a plurality of fins, may be fitted inside the machine housing 52 to form an annular space therebetween that acts as a cooling jacket for cooling gas to pass through. As noted, the cooling fins 82 dissipate heat to the atmosphere via natural convection and radiation heat transfer.

After passing through the cooling channels 80 (Stage C) and attaining the lowest temperature of the cooling cycle, the gas is distributed to a rear end cavity 84 defined by the end cover 72 (Stage D). From the rear end cavity 84, the gas is drawn through the axial interior cavity of the machine housing 52 across the components of the rotating assembly 34. Thus, continued operation of the cooling fan 62 of the fan ring 36, redistributes the gas from the rear end cavity 84 across and along the rotating assembly 34 (Stage A), thus repeating the cooling cycle. Accordingly, the blower 10 of the present invention utilizes a unique self-sustaining cooling system aided by the hermetically sealed design of the blower 10.

Additional cooling capability can be provided in the blower 10 by adding a secondary cooling fan, preferably provided on the rear end of the rotating assembly 34, much in the general manner illustrated in the alternate embodiments shown in FIGS. 8-11.

High temperature capability is one of the core technical challenges of any blower design for use in high temperature applications. Materials chosen for construction of the blower 10 are widely recognized materials for high temperature applications. These materials permit even thermal growth in the system due to heat. This avoids warpage due to stressed joints and connections. The materials used are also preferably corrosion resistant at elevated temperatures. This allows any process gas to be used with the blower 10 of the present invention.

The blower 10 of the present invention addresses many of the concerns and drawbacks associated with prior art blowers in high temperature operations by using the technology of foil gas bearings that allow a sealed, contamination free, high speed, efficient, self cooling centrifugal blower system. As noted, the cold side 14 of the blower 10 illustrated in FIG. 2 includes foil gas journal bearings 70*a* and 70*b* and foil gas thrust bearings 68*a* and 68*b*. All bearings are oil free. The foil gas journal bearings 70*a* and 70*b* sit inside journal bearing sleeves 64*a* and 64*b* that are attached to the machine housing 52. The foil gas thrust bearings 68*a* and 68*b* are positioned within the machine housing 52 around the thrust runner 44. As so positioned, they are pinned and sandwiched between the stack of assembly comprising the rear journal bearing sleeve 64*b*, the thrust runner 44 and the outer plate 73. One thrust bearing is disposed about the thrust runner 44 to operate in clockwise direction relative to the rotating assembly 34, while the other is disposed as a counterclockwise bearing relative to the rotating assembly 34.

Figure 7A:
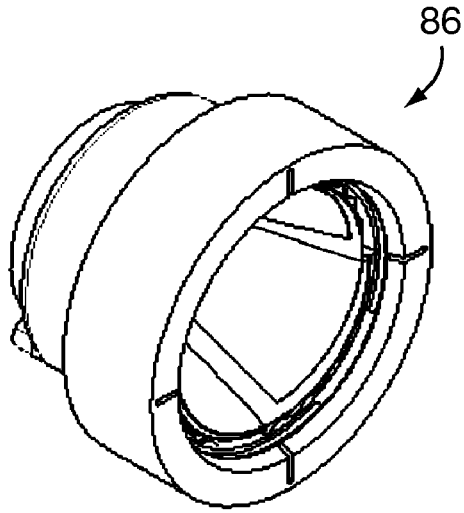
FIGS. 7A and 7B show, respectively, a perspective view and an exploded perspective view of an exemplary conical foil gas bearing assembly that may be used in a blower assembly in accordance with the present invention.
Figure 7B:
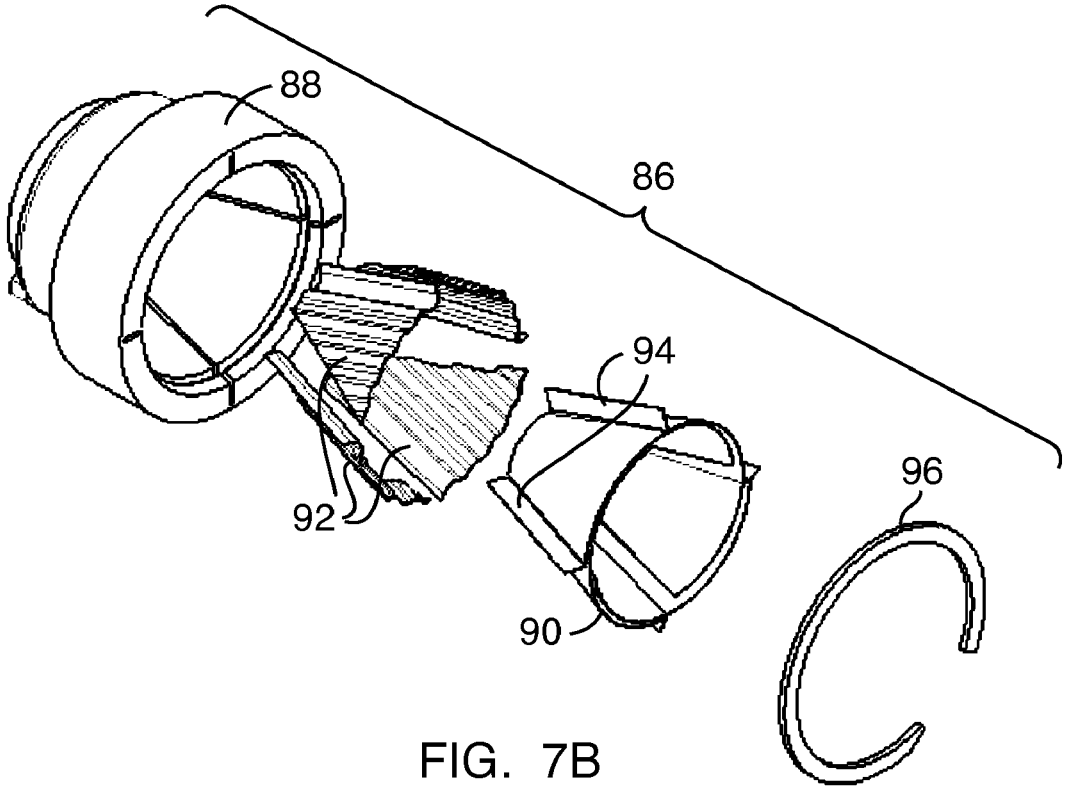

To achieve high efficiency and high temperature applicability the blower 10 must be a high speed machine and should have high temperature capability, which may be achieved by supporting the rotating assembly 34 on foil gas conical bearings 86 as shown in FIGS. 7A and 7B. Foil gas conical bearings in accordance with the present invention can accommodate both axial and radial load with low power loss. Such foil gas conical bearings can run reliably at high temperature, about 1600° F., and thus are well suited to the blower applications envisioned by the present invention. In operation, the shaft of the rotating assembly rubs on the foil gas conical bearings at low speed of few thousand rpm. Once the speed is high enough, the shaft lifts off and is supported on the fluid wedge formed between the foil gas conical bearings and the shaft. The foil gas conical bearings pull in process gas between foil and shaft to form the fluid wedge on which it floats. Preferably, the rotating assembly 34 is supported on high-speed—generally 40,000 to 200,000—foil gas bearings and stationary mounting parts that are properly designed and balanced to handle high temperatures.

Hence conical bearings have fewer parts compared to standard bearings and consequently less associated losses. Conical bearings are also cheaper and have better load carrying capacities. Moreover, conical bearings have three times as much load carrying capacity as of a standard bearing. Correspondingly, power loss is about one-third the loss of a standard bearing.

As shown in FIG. 7B, the foil gas conical bearing 86 includes a retaining member, preferably a conical sleeve 88 with a conical opening to accept a shaft on which is mounted a complementary-shaped conical journal—e.g., a conical shaped sub-assembly of foils comprised of an inner foil 90 supported by corrugated elastic spring foil 92. The conical shaped foil sub-assembly is kept stationary by bent tabs 94 along the rotating axis which are located in grooves in the stationary sleeve 88. A retaining ring 96 attached to the sleeve 88 prevents the axial movement of the foils 90 and 92.

Figure 8:
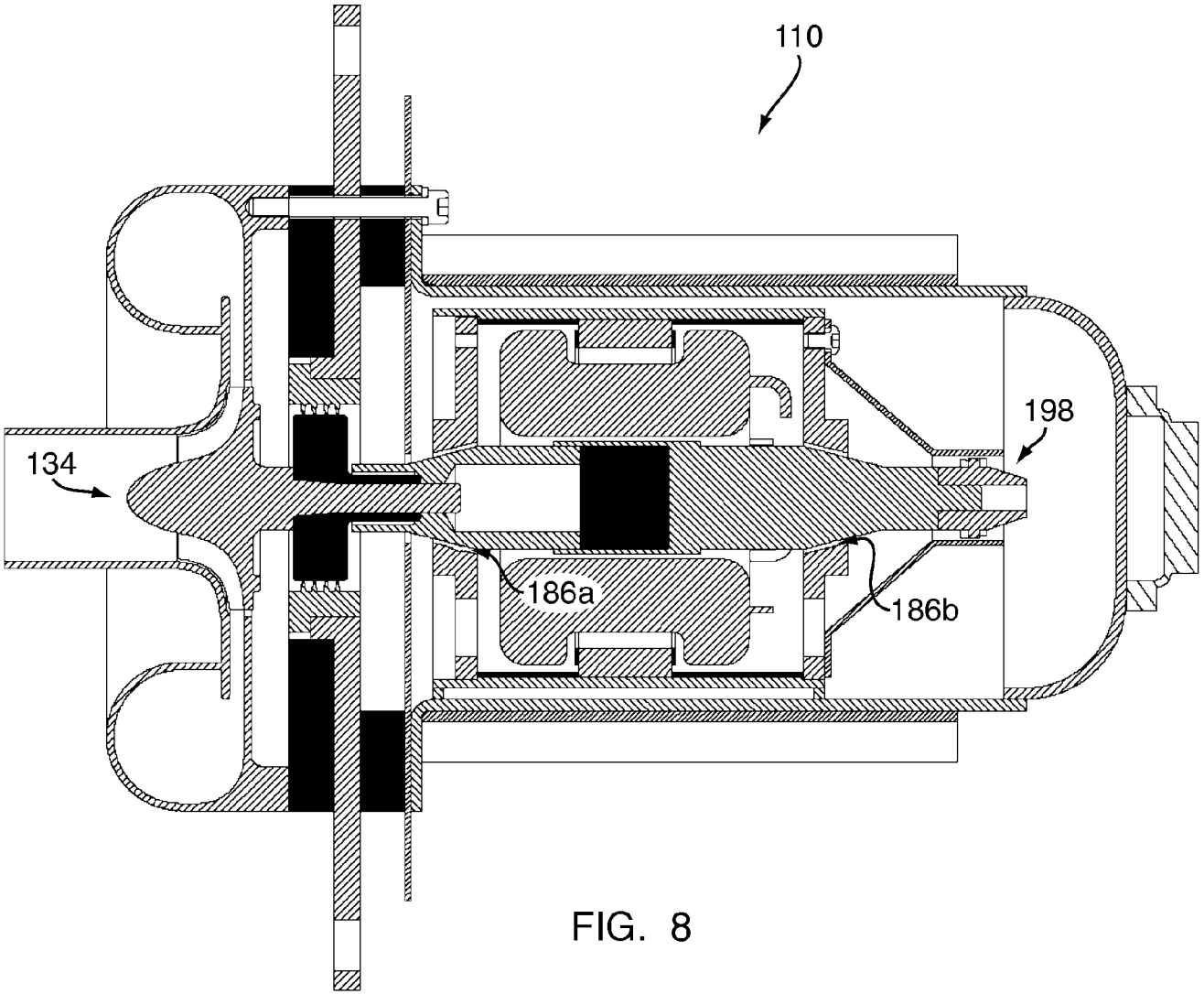
FIG. 8 shows a cross-sectional view of an alternate embodiment of a blower assembly in accordance with the present invention using two foil gas conical bearings and an axial cooling fan at the rear.

FIG. 8 illustrates a foil gas conical bearing for a high temperature fuel cell blower application. This configuration uses an axial cooling fan 198 at the rear end of the blower 110 along with front and rear foil gas conical bearings 186*a* and 186*b*. In comparison with the embodiment of FIG. 2, this alternate configuration does not require thrust bearings since the foil gas conical bearings 186*a* and 186*b* in the front and rear take both the radial and axial loads exerted on the rotating assembly 134 of the blower 110. This configuration also eliminates the need for a thrust runner, thereby reducing the number of parts needed, as well as the level of bearing losses. This fuel cell blower 110 utilizes the self-sustaining cooling scheme of the present invention described above, however, with the axial cooling fan 198 drawing air through the machine housing 152. The fan ring design described above may be easily incorporated into the blower 110. Likewise, the thermal choke plate assembly described above can be incorporated into this configuration so as to form a thermal barrier between a hot side and a cold side of the blower 110 so that operations of the blower at high temperatures are not affected.

Figure 9:
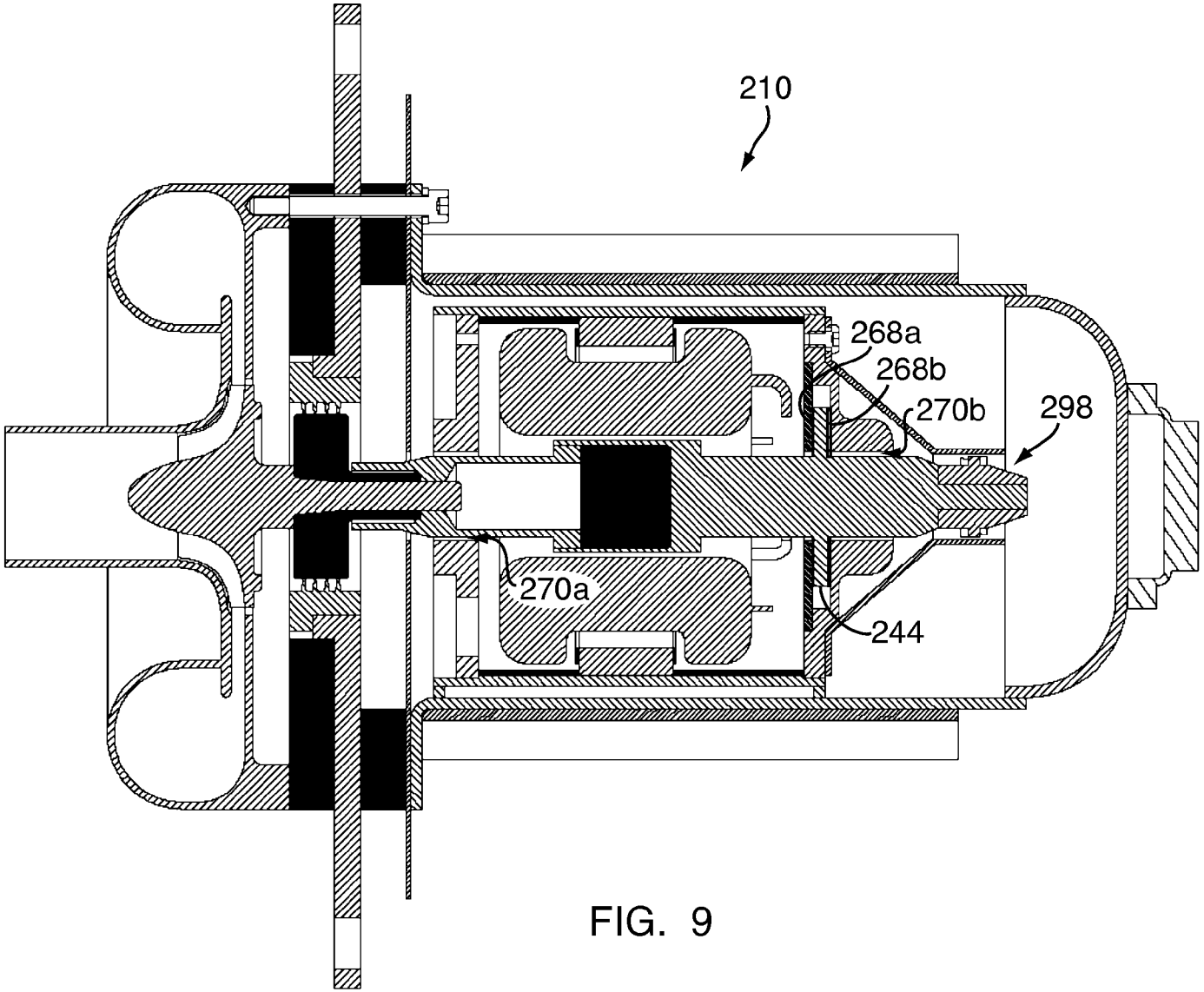
FIG. 9 shows a cross-sectional view of another alternate embodiment of a blower assembly in accordance with the present invention using two foil gas journal bearings and two foil gas conical bearings and an axial cooling fan at the rear.

FIG. 9 illustrates another alternate embodiment for a high temperature blower application. Here, much like the configuration of FIG. 8, two foil gas bearings are used, one on the front end of the rotating assembly and one on the rear end of the rotating assembly, with an axial cooling fan 298 positioned at the rear of the blower assembly 210. However, in comparison with FIG. 8, this new configuration merely uses foil gas journal bearings 270*a* and 270*b* instead of conical bearings, and further includes foil gas thrust bearings 268*a* and 268*b* and a thrust runner 244 adjacent the rear end of the rotating assembly 234. As with the embodiment of FIG. 8, the blower assembly 210 may include the fan ring design and/or the thermal choke plate assembly described above to form a thermal barrier between a hot side and a cold side of the blower assembly 210 so that operations of the blower assembly at high temperatures are not affected.

Figure 10:
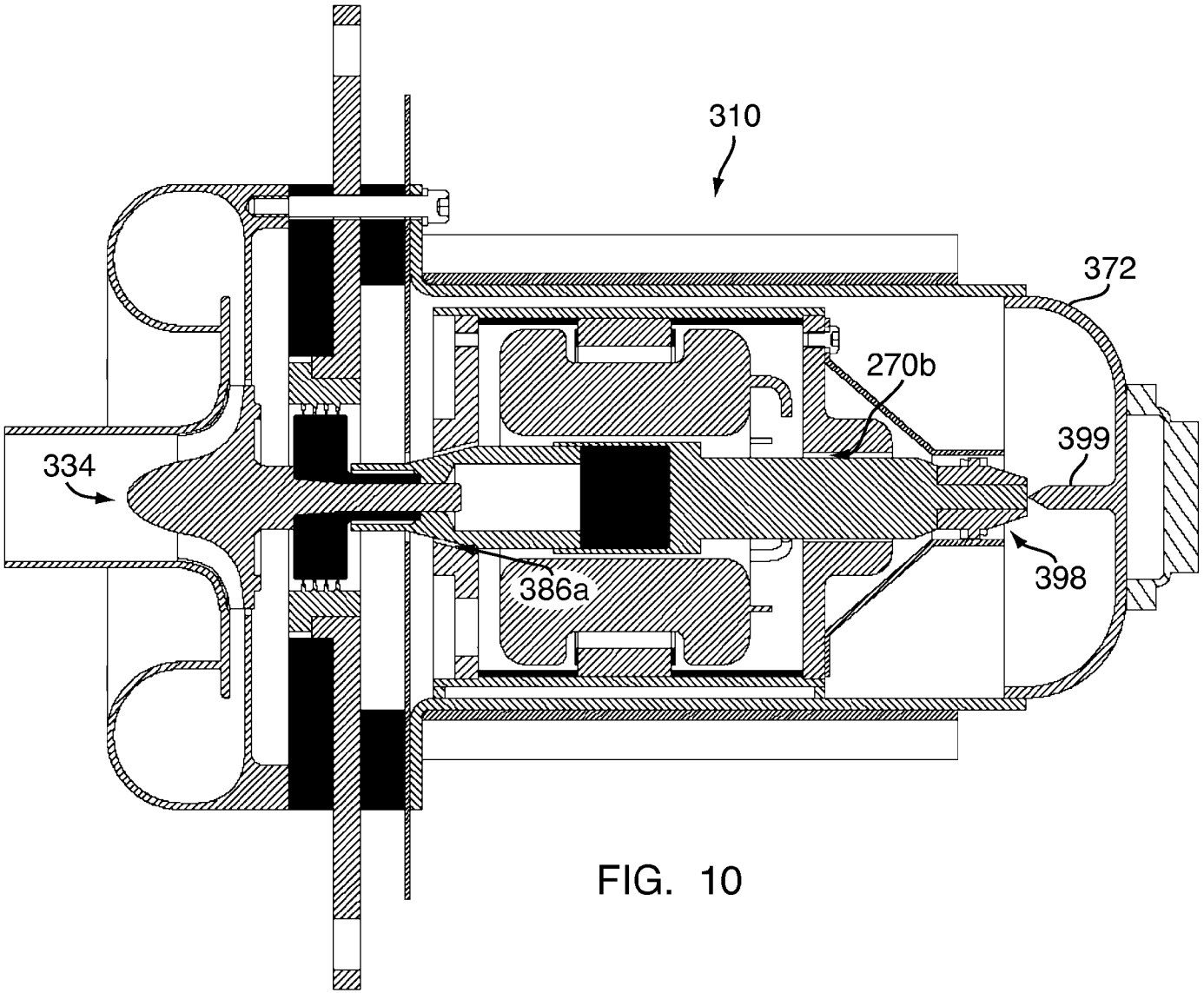
FIG. 10 shows a cross-sectional view of another alternate embodiment of a blower assembly in accordance with the present invention using one foil gas conical bearing at the front, one foil gas journal bearing at the rear, and an axial cooling fan at the rear.

FIG. 10 illustrates another alternate embodiment for a high temperature blower application. In this configuration, a foil gas conical bearing 386*a* is provided on the front end of the rotating assembly 334 and takes up radial load as well as one directional axial load. A foil gas journal bearing 370*b* is provided on the rear end of the rotating assembly 334 to handle radial load. In the same manner as shown in FIGS. 8 and 9, an axial cooling fan 398 is positioned on the rear end of the rotating assembly 334. Lastly, a stopper 399 is provided at the rear end of the blower assembly 310, preferably extending inwardly from the end cover 372. The stopper 399 prevents the movement of the rotating assembly 334 in an opposite axial direction due to reverse thrust load. In comparison with the configuration shown in FIG. 2 this configuration does not require thrust bearings or a thrust runner. As with the embodiments of FIGS. 8 and 9, the blower assembly 310 may include the fan ring design and/or the thermal choke plate assembly described above to form a thermal barrier between a hot side and a cold side of the blower assembly 310 so that operations of the blower assembly at high temperatures are not affected.

Figure 11:
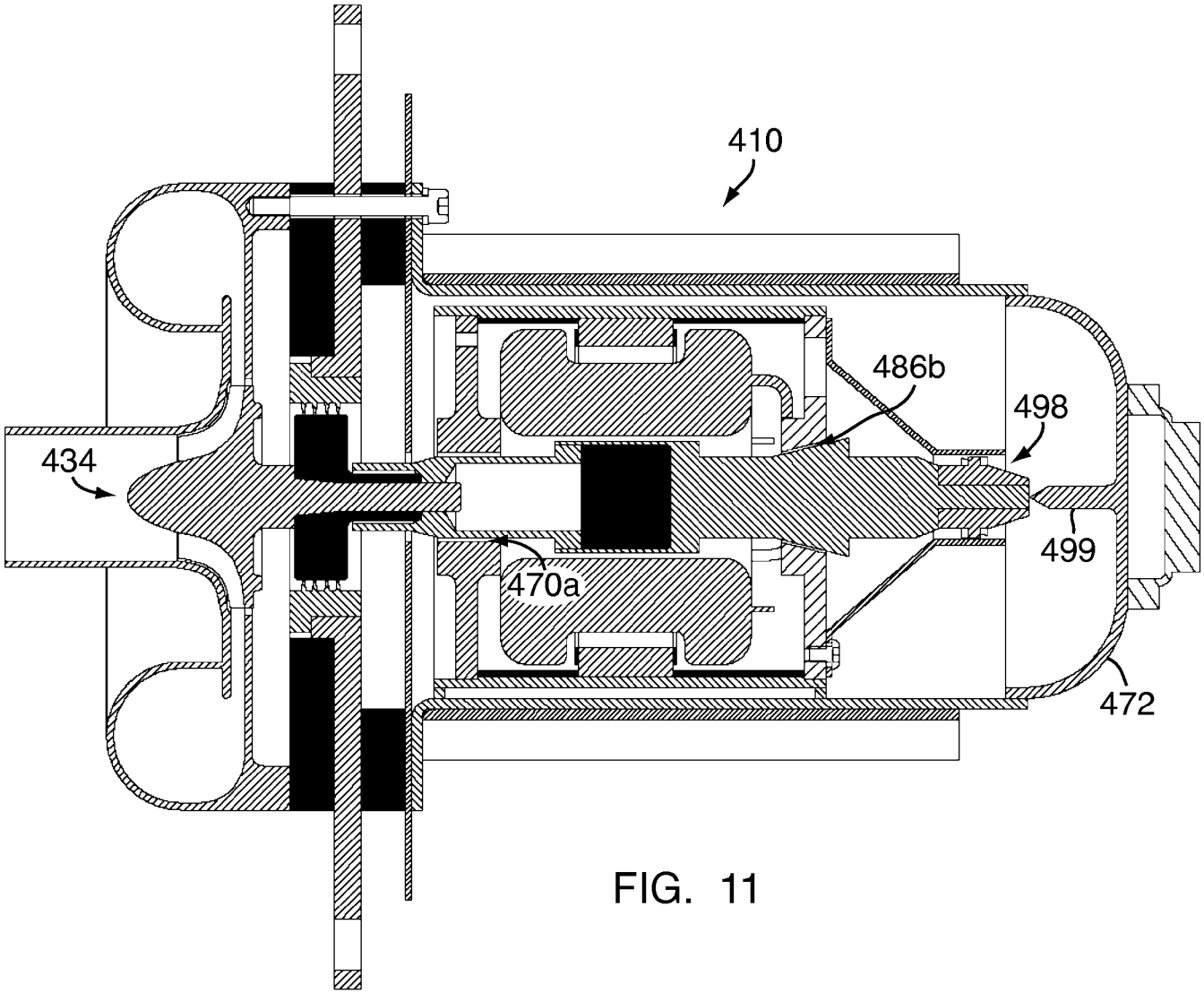
FIG. 11 shows a cross-sectional view of another alternate embodiment of a blower assembly in accordance with the present invention using one foil gas journal bearing at the front, one foil gas conical bearing at the rear, an axial cooling fan at the rear, and a stopper at the rear.

FIG. 11 illustrates another alternate embodiment for a high temperature blower application. In this configuration, a foil gas journal bearing 470*a* is provided on the front end of the rotating assembly 434 and takes up radial load. A foil gas conical bearing 486*b* is provided on the rear end of the rotating assembly 434 to handle both radial and axial loads when the latter is uni-directional. As with the configuration in FIG. 10, a stopper 499 is provided on the end cover 472 at the rear end of the blower assembly 410 to inhibit the axial movement of the shaft in the opposite direction from that handled by the foil gas conical bearing 486*b*. Again, an axial cooling fan 498 is located at the rear end of the rotating assembly 434. In comparison with the configuration shown in FIG. 2, this configuration does not require thrust bearings or a thrust runner. As with the embodiments of FIGS. 8-10, the blower assembly 410 may include the fan ring design and/or the thermal choke plate assembly described above to form a thermal barrier between a hot side and a cold side of the blower assembly 410 so that operations of the blower assembly at high temperatures are not affected.

Figure 12:
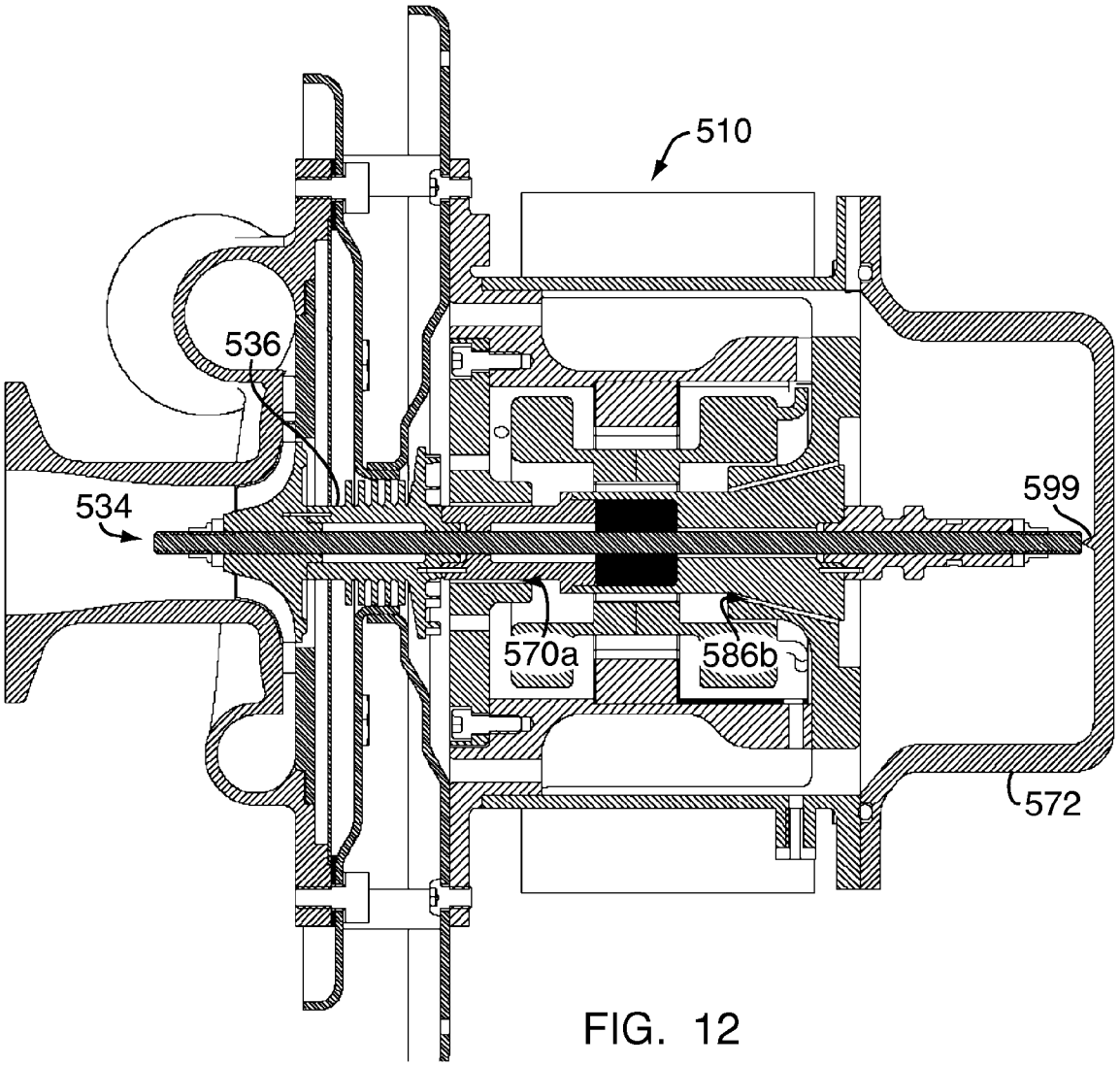
FIG. 12 shows a cross-sectional view of another alternate embodiment of a blower assembly in accordance with the present invention using one foil gas journal bearing at the front, one foil gas conical bearing at the rear, a centrifugal cooling fan ring design up front, and a stopper at the rear.

FIG. 12 illustrates another alternate embodiment of the blower assembly shown in FIG. 2. This configuration has one foil gas journal bearing 570*a* on the front end of the rotating assembly 534 that takes up radial load. A foil gas conical bearing 586*b* is provided on the rear end of the rotating assembly 534 to handle both radial and axial loads when the latter is unidirectional. This configuration also includes a stopper 599 provided on the end cover 572 at the rear end of the blower assembly 510 to inhibit the axial movement of the rotating assembly 534 in the opposite direction from that handled by the foil gas conical bearing 586*b*. A centrifugal cooling fan 536, illustrated in accordance with the unique fan ring described above with respect to the embodiment of FIG. 2, is located at the front end of the rotating assembly 534. In comparison with the configuration shown in FIG. 2, this configuration does not require thrust bearings or a thrust runner. This blower assembly 510 utilizes the self-sustaining cooling scheme of the present invention described above. Likewise, the thermal choke plate assembly described above can be incorporated into this configuration so as to form a thermal barrier between a hot side and a cold side of the blower 510 so that operations of the blower at high temperatures are not affected.

The various embodiments of a blower assembly described and illustrated herein can be used in various commercial and military applications, including fuel cell anode blowers, fuel cell systems for transportation, automotive exhaust after treatment systems, heat furnace blowers, and the like.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A blower for processing a gas, comprising:

(a) a blower hot side, including:

a volute with a process gas inlet and a process gas outlet, a diffuser attached to the volute for directing the flow of the process gas through the volute, and an impeller mounted for rotation about a central longitudinal axis within the volute for processing the gas as it flows through the volute;

(b) a blower cold side, including:

a sealed motor housing defining an interior cavity, a rotating assembly disposed within the interior cavity of the motor housing, comprising:

a rotating shaft mounted for rotation about the central longitudinal axis, and a motor rotor mounted on the rotating assembly for rotation with the rotating shaft, wherein the impeller is mounted at an end of the rotating assembly for rotation therewith; and a motor stator assembly mounted in stationary relationship within the motor housing relative to the rotor;

(c) a thermal barrier positioned between the blower hot side and the blower cold side for reducing heat transfer from the blower hot side to the blower cold side; and a radiation heat shield positioned against the exterior surface of the volute adjacent to the thermal barrier for reflecting heat radiated from the blower hot side.

2. The blower of claim 1, wherein the thermal barrier is formed by a thermal choke plate assembly, comprising:

an outer choke plate disposed adjacent to the blower hot side;

an inner choke plate disposed adjacent to the blower cold side; and a transition between the outer choke plate and the inner choke plate;

wherein heat transferred from the blower hot side is directed, in part, to the outer choke plate through the transition and to the inner choke plate, and further wherein heat is dissipated from the thermal choke plate assembly as it passes from the outer choke plate to the inner choke plate to form a temperature gradient across the hot and cold sides of the blower.

3. The blower of claim 2, wherein the inner choke plate has a greater surface area than the outer choke plate.

4. The blower of claim 2 wherein the thermal choke plate assembly further comprises a plurality of spacers between the outer choke plate and the inner choke plate, wherein heat may be directed from the outer choke plate to the inner choke plate through said spacers.

5. The blower of claim 2 wherein the transition of the thermal choke plate assembly is a neck portion located at the respective interior diameters of the outer and inner choke plates, said neck portion being disposed adjacent to the rotating assembly where heat from the rotating assembly may be conducted to the thermal choke plate assembly via the neck portion.

6. The blower of claim 2 wherein the radiation heat shield is positioned against the exterior surface of the volute adjacent to the outer choke plate for reflecting heat radiated from the blower hot side.

7. A blower for processing a gas, comprising:

(a) a blower hot side, including:

a volute with a process gas inlet and a process gas outlet, a diffuser attached to the volute for directing the flow of the process gas through the volute, and an impeller mounted for rotation about a central longitudinal axis within the volute for processing the gas as it flows through the volute;

(b) a blower cold side, including:

a sealed motor housing defining an interior cavity, a rotating assembly disposed within the interior cavity of the motor housing, comprising:

a rotating shaft mounted for rotation about the central longitudinal axis, and a motor rotor mounted on the rotating assembly for rotation with the rotating shaft, wherein the impeller is mounted at an end of the rotating assembly for rotation therewith; and a motor stator assembly mounted in stationary relationship within the motor housing relative to the rotor, and;

(c) a thermal barrier positioned between the blower hot side and the blower cold side for reducing heat transfer from the blower hot side to the blower cold side; wherein the thermal barrier comprises at least one of:

a thermal choke plate assembly, comprising:

an outer choke plate disposed adjacent to the blower hot side;

an inner choke plate disposed adjacent to the blower cold side; and a transition between the outer choke plate and the inner choke plate;

wherein said outer choke plate and said inner choke plate are axially spaced apart from one another and connected together by said transition such that heat transferred from the blower hot side to the outer choke plate is directed to the inner choke plate via the transition, and further wherein heat is dissipated from the thermal choke plate assembly as it passes from the outer choke plate to the inner choke plate to form a temperature gradient across the hot and cold sides of the blower; and a fan ring mounted on the rotating assembly between the impeller and the motor rotor, said fan ring comprising:

a generally longitudinal hub portion having a first end and a second end and being mounted on the rotating assembly for rotation therewith;

a radial cooling fan at the second end and having a plurality of fan blades facing the blower cold side; and a bellows feature positioned intermediate the first and second ends and including a plurality of heat fins extending radially from the hub portion, wherein heat conducted from the impeller is dissipated by the fan ring.

8. The blower of claim 7 wherein the bellows feature of the fan ring defines a seal within the blower to block the leakage of process gas from the blower hot side to the blower cold side.

9. The blower of claim 7 wherein the fan ring forms a part of the rotating shaft.

10. The blower of claim 7 wherein the impeller is attached to the first end of the fan ring.

11. A blower for processing a gas, comprising:

(a) a blower hot side, including:

a volute with a process gas inlet and a process gas outlet, a diffuser attached to the volute for directing the flow of the process gas through the volute, and an impeller mounted for rotation about a central longitudinal axis within the volute for processing the gas as it flows through the volute;

(b) a blower cold side, including:

a sealed motor housing defining an interior cavity, a rotating assembly disposed within the interior cavity of the motor housing, comprising:

a rotating shaft mounted for rotation about the central longitudinal axis, and a motor rotor mounted on the rotating assembly for rotation with the rotating shaft, wherein the impeller is mounted at an end of the rotating assembly for rotation therewith; and a motor stator assembly mounted in stationary relationship within the motor housing relative to the rotor, and;

(c) a thermal barrier positioned between the blower hot side and the blower cold side for reducing heat transfer from the blower hot side to the blower cold side; wherein the thermal barrier comprises:

(i) a thermal choke plate assembly, comprising:

an outer choke plate disposed adjacent to the blower hot side;

an inner choke plate disposed adjacent to the blower cold side; and a transition between the outer choke plate and the inner choke plate;

wherein heat transferred from the blower hot side is directed, in part, to the outer choke plate through the transition and to the inner choke plate, and further wherein heat is dissipated from the thermal choke plate assembly as it passes from the outer choke plate to the inner choke plate to form a temperature gradient across the hot and cold sides of the blower; and (ii) a fan ring mounted on the rotating assembly between the impeller and the motor rotor, said fan ring comprising:

a generally longitudinal hub portion having a first end and a second end and being mounted on the rotating assembly for rotation therewith;

a radial cooling fan at the second end and having a plurality of fan blades facing the blower cold side; and a bellows feature positioned intermediate the first and second ends and including a plurality of heat fins extending radially from the hub portion, wherein heat conducted from the impeller is dissipated by the fan ring.

12. The blower of claim 11 wherein the transition of the thermal choke plate assembly is a neck portion located at the respective interior diameters of the outer and inner choke plates, said neck portion being disposed adjacent to the fan ring where heat from the rotating assembly may be dissipated from the heat fins of the fan ring and conducted to the thermal choke plate assembly via the neck portion.

13. The blower of claim 11 wherein the bellows feature of the fan ring defines a seal within the blower to block the leakage of process gas from the blower hot side to the blower cold side with the tips of the heat fins being generally adjacent to the neck portion of the thermal choke plate assembly.

14. The blower of claim 11 further comprising a radiation heat shield positioned against the exterior surface of the volute adjacent to the outer choke plate for reflecting heat radiated from the blower hot side.

15. A rotating assembly for use in a centrifugal blower, comprising:

a rotating shaft mounted for rotation about an axis;

an impeller mounted at a first end of the rotating shaft;

at least two hydrodynamic foil bearing assemblies mounted in association with the blower for supporting the rotating shaft;

a motor rotor forming an armature of the blower, said rotor being mounted for rotation with the rotating shaft;

a fan ring comprising:

a generally longitudinal hub portion having a first end and a second end and being mounted for rotation with the rotating shaft;

a radial cooling fan at the second end and having a plurality of fan blades facing the motor rotor; and a bellows feature positioned intermediate the first and second ends and including a plurality of heat fins extending radially from the hub portion, wherein heat conducted from the impeller may be dissipated by the fan ring; and a tie rod extending along the axis of rotation and holding the impeller, the rotating shaft, the motor rotor and the fan ring under preload.

16. The rotating assembly of claim 15 further comprising at least one hydrodynamic foil thrust bearing assembly having a thrust runner mounted for rotation with the rotating shaft adjacent a second end thereof opposing the impeller.

17. The rotating assembly of claim 15 wherein at least one of the hydrodynamic foil bearing assemblies comprises a foil gas conical bearing including:

a conical sleeve mounted in the blower and having a conical opening adapted to receive the rotating shaft;

a conical-shaped foil assembly comprising a conical inner foil and at least one corrugated elastic spring foil; and a retaining ring attached to the conical sleeve to prevent axial movement of the conical-shaped foil assembly.

18. The rotating assembly of claim 17 wherein the foil gas conical bearing is provided between the motor rotor and the impeller.

19. The rotating assembly of claim 17 wherein the foil gas conical bearing is provided between the motor rotor and the second end of the rotating shaft.

20. The rotating assembly of claim 17 comprising two foil gas conical bearings, one of which is provided between the motor rotor and the impeller and the other of which is provided between the motor rotor and the second end of the rotating shaft.

21. The rotating assembly of claim 15 wherein the fan ring forms a part of the rotating shaft.

22. The rotating assembly of claim 15 wherein the impeller is attached to the first end of the fan ring.

23. The rotating assembly of claim 15 further comprising a secondary axial fan mounted at a second end of the rotating shaft opposing the impeller.

24. A method of cooling a centrifugal blower comprising:

providing a sealed blower housing having a front end and a rear end and defining an axial interior cavity, radially disposed cooling channels, a front end cavity and a rear end cavity;

providing a plurality of cooling fins about the outer surface of the blower housing, said cooling fins being generally adjacent the radially disposed cooling channels inside the blower housing;

providing a rotating assembly within the axial interior cavity, said rotating assembly being mounted for rotation about an axis and comprising a rotating shaft, an impeller mounted at a first end of the rotating shaft and being disposed within a volute, and a fan ring adjacent to the impeller, said fan ring having a radial cooling fan facing the rear end of the blower housing and including a plurality of fan blades;

drawing gas through the axial interior cavity of the blower housing along the rotating assembly by rotating the radial cooling fan, said gas taking up heat from components of the rotating assembly;

distributing the hot gas into the front end cavity;

directing the hot gas to and through the radially disposed cooling channels;

cooling the hot gas as it passes through the radially disposed cooling channels by conducting heat from the hot gas from the radially disposed cooling channels to the cooling fins where the heat may be released therefrom to the ambient air around the blower housing; and distributing the cooled gas to the rear end cavity where it may be drawn into and through the axial interior cavity by rotation of the radial cooling fan.

25. The method of claim 24 further comprising reducing heat transfer from the impeller, wherein said reducing step includes providing a thermal choke plate assembly between the blower housing and the volute to dissipate heat generated by operation of the impeller, said thermal choke plate assembly comprising:

an outer choke plate disposed adjacent to the volute;

an inner choke plate disposed adjacent to the blower housing; and a transition between the outer choke plate and the inner choke plate;

wherein heat transferred from the impeller and volute is directed, in part, to the outer choke plate through the transition and to the inner choke plate, and further wherein heat is dissipated from the thermal choke plate assembly as it passes from the outer choke plate to the inner choke plate to form a temperature gradient across the blower.

26. The method of claim 24 further comprising reducing heat transfer from the impeller, wherein said reducing step includes providing a radiation heat shield positioned against the exterior surface of the volute for reflecting heat radiated from the impeller and the volute.

27. The method of claim 24 further comprising reducing heat transfer from the impeller, wherein said reducing step includes providing a bellows feature having a plurality of radially extending heat fins on the fan ring, wherein heat conducted from the impeller is dissipated from the heat fins.

28. The method of claim 27 wherein said reducing step includes providing a thermal choke plate assembly between the blower housing and the volute to dissipate heat generated by operation of the impeller, said thermal choke plate assembly comprising:

an outer choke plate disposed adjacent to the volute;

an inner choke plate disposed adjacent to the blower housing; and a transition between the outer choke plate and the inner choke plate;

wherein heat transferred from the impeller and volute is directed, in part, to the outer choke plate through the transition and to the inner choke plate, and further wherein heat is dissipated from the thermal choke plate assembly as it passes from the outer choke plate to the inner choke plate to form a temperature gradient across the blower.

29. The method of claim 27 wherein said reducing step further includes forming a seal with the heat fins of the fan ring to block flows of hot gas from the impeller into the blower housing.

30. A method of cooling a blower comprising:

providing a blower hot side comprising a volute, a diffuser and an impeller, wherein the impeller is mounted for rotation with respect to the volute and the diffuser to process a gas as it flows through the blower hot side;

providing a blower cold side comprising a sealed blower housing defining an axial interior cavity, radially disposed cooling channels, a front end cavity and a rear end cavity;

providing a rotating assembly within the axial interior cavity, said rotating assembly being mounted for rotation about an axis and comprising a rotating shaft;

mounting the impeller at a first end of the rotating shaft so that the impeller and the rotating shaft rotate together;

forming a thermal barrier in the blower to separate the blower hot side from the blower cold side and to reduce heat transfer therebetween; and reflecting heat radiated from the blower hot side.

31. A method of cooling a blower comprising:

providing a blower hot side comprising a volute, a diffuser and an impeller, wherein the impeller is mounted for rotation with respect to the volute and the diffuser to process a gas as it flows through the blower hot side;

providing a blower cold side comprising a sealed blower housing defining an axial interior cavity, radially disposed cooling channels, a front end cavity and a rear end cavity;

providing a rotating assembly within the axial interior cavity, said rotating assembly being mounted for rotation about an axis and comprising a rotating shaft;

mounting the impeller at a first end of the rotating shaft so that the impeller and the rotating shaft rotate together; and forming a thermal barrier in the blower to separate the blower hot side from the blower cold side and to reduce heat transfer therebetween, wherein the thermal barrier is formed by at least one of:

providing a thermal choke plate assembly between the blower hot side and the blower cold side to dissipate heat generated by operation of the impeller, said thermal choke plate assembly comprising:

an outer choke plate disposed adjacent to the blower hot side;

an inner choke plate disposed adjacent to the blower cold side; and a transition between the outer choke plate and the inner choke plate, wherein said outer choke plate and said inner choke plate are axially spaced apart from one another and connected together by said transition; and mounting a fan ring on the rotating assembly between the blower hot side and the blower cold side, said fan ring comprising:

a generally longitudinal hub portion having a first end and a second end and being mounted on the rotating assembly for rotation therewith;

a bellows feature positioned intermediate the first and second end and including a plurality of heat fins extending radially from the hub portion, and dissipating heat conducted from the impeller though said plurality of heat fins.

32. The method of claim 31 further comprising dissipating heat from the blower hot side to the ambient air by directing said heat to the outer choke plate, directing said heat from the outer choke plate through the transition, directing said heat from the transition to the inner choke plate, and transferring said heat to ambient air as it is directed along the components of the thermal choke plate assembly.

33. The method of claim 31, a wherein said fan ring further comprises a radial cooling fan at the second end and having a plurality of fan blades facing the blower cold side, further wherein said method comprises cooling the blower cold side by drawing and distributing gas through the blower housing upon rotation of the radial cooling fan.

34. The method of claim 30 wherein the thermal barrier is formed by:

(a) providing a thermal choke plate assembly between the blower hot side and the blower cold side to dissipate heat generated by operation of the impeller, said thermal choke plate assembly comprising:

an outer choke plate disposed adjacent to the blower hot side, an inner choke plate disposed adjacent to the blower cold side, and a transition between the outer choke plate and the inner choke plate; and (b) mounting a fan ring on the rotating assembly between the blower hot side and the blower cold side, said fan ring comprising:

a generally longitudinal hub portion having a first end and a second end and being mounted on the rotating assembly for rotation therewith, and a bellows feature positioned intermediate the first and second end and including a plurality of heat fins extending radially from the hub portion.

35. The method of claim 30 further comprising providing a radiation heat shield positioned against the exterior surface of the volute for reflecting heat radiated from the blower hot side.

* * * * *